US008506730B2

(12) United States Patent
Oishi

(10) Patent No.: US 8,506,730 B2
(45) Date of Patent: Aug. 13, 2013

(54) COPPER/ZINC ALLOYS HAVING LOW LEVELS OF LEAD AND GOOD MACHINABILITY

(75) Inventor: Keiichiro Oishi, Sakai (JP)

(73) Assignee: Mitsubishi Shindoh Co., Ltd., Tokyo (JP)

( * ) Notice: Subject to any disclaimer, the term of this patent is extended or adjusted under 35 U.S.C. 154(b) by 1036 days.

(21) Appl. No.: 11/094,815

(22) Filed: Mar. 31, 2005

(65) Prior Publication Data

US 2005/0247381 A1 Nov. 10, 2005

Related U.S. Application Data

(63) Continuation-in-part of application No. 09/983,029, filed on Oct. 22, 2001, now Pat. No. 7,056,396, which is a continuation- in-part of application No. 09/403,834, filed as application No. PCT/ JP98/05156 on Nov. 16, 1998, now abandoned.

(30) Foreign Application Priority Data

Oct. 9, 1998 (JP) ..... 10-287921

(51) Int. Cl.
*C22C 1/08* (2006.01)

(52) U.S. Cl.
USPC ..... 148/434; 148/686; 420/477; 420/478; 420/479; 420/481; 420/482; 420/484

(58) Field of Classification Search
USPC ..... 148/434, 686; 420/477–479, 481, 420/482, 484
See application file for complete search history.

(56) References Cited

U.S. PATENT DOCUMENTS

| | | | | |
|---|---|---|---|---|
| 1,954,003 | A | 4/1934 | Vaders | |
| 2,315,700 | A * | 4/1943 | Hehemann | 420/482 |
| 4,055,445 | A | 10/1977 | Pops | |
| 4,676,848 | A | 6/1987 | Ruchel et al. | |
| 5,582,281 | A | 12/1996 | Nakashima et al. | |
| 5,658,401 | A | 8/1997 | Gaag et al. | |
| 5,942,056 | A | 8/1999 | Singh | |
| 6,419,766 | B1 * | 7/2002 | Ikemiya et al. | 148/433 |
| 2002/0159912 | A1 | 10/2002 | Oishi | |
| 2004/0234411 | A1 | 11/2004 | Hofmann et al. | |

FOREIGN PATENT DOCUMENTS

| | | |
|---|---|---|
| CA | 1 243 226 | 10/1988 |
| CH | 148824 | 10/1931 |
| DE | 1558470 | 3/1970 |
| DE | 3427740 A1 | 2/1986 |

(Continued)

OTHER PUBLICATIONS

Mima, Genjiro; Hasegawa, Masaharu, Diagram of copper-silicon-zinc alloys. II,Techology Reports of the Osaka University (1957), 7, 385-97 (AN 1959:1377 CAPLUS, provided with abstract only).*

(Continued)

*Primary Examiner* — Sikyin Ip
(74) *Attorney, Agent, or Firm* — Griffin & Szipl, P.C.

(57) ABSTRACT

The free-cutting copper alloy according to the present invention contains a greatly reduced amount of lead in comparison with conventional free-cutting copper alloys, but provides industrially satisfactory machinability. The free-cutting alloys comprise 69 to 79 percent, by weight, of copper, 2.0 to 4.0 percent, by weight, of silicon, 0.02 to 0.4 percent, by weight, of lead, and the remaining percent, by weight, of zinc.

19 Claims, 1 Drawing Sheet

(56) References Cited

FOREIGN PATENT DOCUMENTS

| | | | | |
|---|---|---|---|---|
| DE | 41 39 063 | A1 | | 6/1993 |
| EP | 947592 | | * | 10/1999 |
| GB | 359570 | | | 10/1931 |
| GB | 1443090 | | | 7/1976 |
| HU | 117048 | | * | 10/1937 |
| JP | 49-9296 | | | 3/1974 |
| JP | 56-9347 | | | 1/1981 |
| JP | 56-96040 | | | 8/1981 |
| JP | 61-133357 | | | 6/1986 |
| JP | 62-274036 | | | 11/1987 |
| JP | 62-297429 | | | 12/1987 |
| JP | 3-68732 | | | 3/1991 |
| JP | 3-68733 | | | 3/1991 |
| JP | 3-110042 | | | 5/1991 |
| JP | 4-224645 | | | 8/1992 |
| JP | 4-246141 | | | 9/1992 |
| JP | 7-310133 | | | 11/1995 |
| JP | 08120369 | | * | 5/1996 |
| JP | 9-143598 | | | 6/1997 |
| JP | 9-316570 | A | | 12/1997 |
| JP | 09316570 | | * | 12/1997 |
| JP | 10-81926 | | | 3/1998 |
| JP | 10-287921 | A2 | | 10/1998 |
| JP | 2000-119774 | A | | 4/2000 |
| JP | 2000-119775 | A2 | | 4/2000 |
| JP | 2002-030364 | | | 1/2002 |
| WO | WO 94/01591 | | | 1/1994 |
| WO | 9810106 | | * | 3/1998 |
| WO | WO 98/10105 | | | 3/1998 |
| WO | 00/22181 | A1 | | 4/2000 |

OTHER PUBLICATIONS

Mima, Genjiro; Hasegawa, Masaharu, Diagram of copper-silicon-zinc alloys. II,Techology Reports of the Osaka University (1957), 7, 385-97.*

Patent Abstracts of Japan, English Abstract corresponding to JP 61-133357, 1986, 1 page.

Patent Abstracts of Japan, English Abstract corresponding to JP 09-143598, 1997 1 page.

Patent Abstracts of Japan, English Abstract corresponding to JP 10-081926, 1998, 1 page.

English Abstract corresponding to R. Manheim et al., "Laton Al Silicic: Una alternativa a las griferias y fittings sin plorno," 1998 (of record).

Mannheim, R., "Laton Al Silicio: Una alternativa a las griferias y fittings sin plomo", Second Int'l Conference on Metallurgic and Materials Technology, 1998, pp. 1-4.

Annual Book of ASTM Standards, "Standard Specification for Copper-Zinc-Silicon Alloy Rod", 1993, pp. 536-538, vol. 02.01.

Standards Handbook, Part 2—Alloy Data, Wrought Copper and Copper Alloy Mill Products, "Copper Alloy No. C69400 (Silicon Red Brass)" 1985, Eighth Edition.

Notice of Reason for Rejection of Japanese Patent Application No. H10-287921, mailed Jan. 22, 2002.

Notice of Reason for Rejection of Japanese Patent Application No. H10-288590, mailed Jan. 29, 2002.

Notice of Protest Received by JPO in Japanese Patent Application No. H10-288590, mailed Jan. 15, 2002.

Office Action for Canadian Patent Application No. 2,303,512 dated Aug. 27, 2004.

Communication pursuant to Article 96(2) EPC, issued from the European Patent Office in Application No. 98 953 070.4, dated Oct. 6, 2003.

European Search Report for EP 98 95 3071.2 completed Sep. 9, 2002, mailed Sep. 23, 2002.

European Search Report for EP 04 07 7560 completed Nov. 18, 2004.

European Search Report for EP 04-07-7561 completed Dec. 14, 2004.

ASM Specialty Handbook, Properties of Cast Copper Alloys, "C87500, C87800, 82Cu—4Si—14Zn, Silicon Brass" , p. 545, 2001.

Robert F. Mehi, Atlas of Microstructures of Industrial Alloys, p. 291, 8th Edition, vol. 7, American Society for Metals, Metals Park, Ohio 44073, (1972).

1994 Annual Book of ASTM Standards, p. 815, Nonferrous Metal Products, vol. 02.01 Copper and Copper Alloys, PA.

JIS, 3, p. 524, 2004, JP.

Metallurgical Aspects of the Control of Quality in Non-Ferrous Castings, A Symposium held in London on the occasion of the Annual General Meeting of the Institute, Institute of Metals Monograph and Report Series, No. 22, (1957).

Metals Handbook, Tenth Edition, vol. 2, Properties of Wrought Coppers and Copper Alloys, pp. 319-321, (1990).

Lee, Hyuck Mo et al. "Thermodynamic Prediction of Interface Phases at Cu/Solder Joints," Journal of Electronic Materials, vol. 27, No. 11, 1998, pp. 1161-1166.

Ternary Phase Diagrams, What is a ternary phase diagram?, Ternary phase diagram overview at http://www.sv.vt.edu/classes/MSE2094_NoteBook/96ClassProj/exp . . . , 3 pages, downloaded May 3, 2006.

Metals Handbook, Eighth Edition, vol. 8, Metallography, Structures and Phase Diagrams, pp. 301, 294, 425, 394, 413, 408 and 275, (1973).

1994 Annual Book of ASTM Standards, Section 2, Nonferrous Metal Products, vol. 02.01, Copper and Copper Alloys, Cast Alloys, p. 824.

* cited by examiner

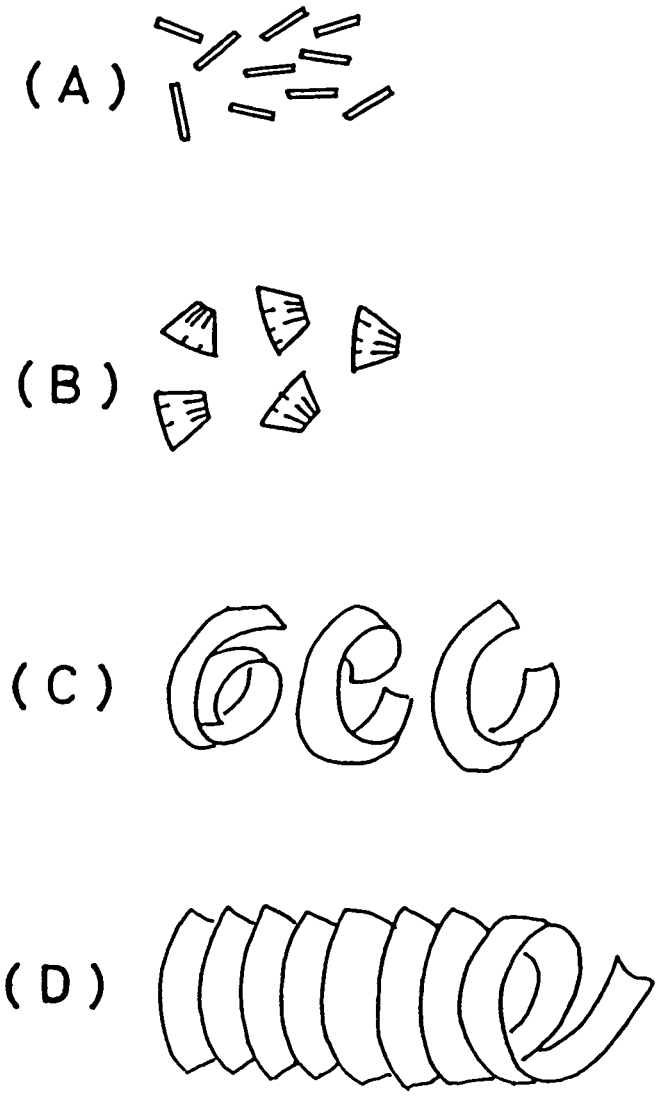
(A)
(B)
(C)
(D)

COPPER/ZINC ALLOYS HAVING LOW LEVELS OF LEAD AND GOOD MACHINABILITY

The present application is a continuation-in-part of U.S. patent application Ser. No. 09/983,029, filed Oct. 22, 2001, now U.S. Pat. No. 7,056,396, which is a continuation-in-part of U.S. patent application Ser. No. 09/403,834, filed on Oct. 27, 1999 (now abandoned), which is a U.S. National Phase application of International Application No. PCT/JP98/05156, filed Nov. 16, 1998 and which claims priority from Japanese Application No. JP 10-287921, filed Oct. 9, 1998. The present application incorporates herein by reference the full disclosures of U.S. patent application Ser. No. 09/983,029, and of U.S. patent application Ser. No. 09/403,834, and of International Application No. PCT/JP98/05156, and of Japanese Application No. JP 10-287921.

BACKGROUND OF THE INVENTION

1. Field of the Invention

The present invention relates to free-cutting copper alloys.

2. Prior Art

Among the copper alloys with a good machinability are bronze alloys such as that having the JIS designation H5111 BC6 and brass alloys such as those having the JIS designations H3250-C3604 and C3771. Those alloys are enhanced in machinability with the addition of 1.0 to 6.0 percent, by weight, of lead so as to give industrially satisfactory results as easy-to-work copper alloys. Because of their excellent machinability, those lead-containing copper alloys have been an important basic material for a variety of articles such as city water faucets and water supply/drainage metal fittings and valves.

In those conventional free-cutting copper alloys, lead does not form a solid solution in the matrix but disperses in granular form, thereby improving the machinability of those alloys. To produce the desired results, lead has to be added in as much as 2.0 or more percent by weight. If the addition of lead is less than 1.0 percent by weight, chippings will be spiral in form, as (D) in FIG. 1. Spiral chippings cause various troubles such as, for example, tangling with the tool. If, on the other hand, the content of lead is 1.0 or more percent by weight and not larger than 2.0 percent by weight, the cut surface will be rough, though that will produce some results such as reduction of cutting resistance. It is usual, therefore, that lead is added to an extent of not less than 2.0 percent by weight. Some expanded copper alloys in which a high degree of cutting property is required are mixed with some 3.0 or more percent by weight of lead. Further, some bronze castings have a lead content of as much as some 5.0 percent, by weight. The alloy having the JIS designation H 5111 BC6, for example, contains some 5.0 percent by weight of lead.

However, the application of those lead-mixed alloys has been greatly limited in recent years, because lead contained therein is harmful to humans as an environment pollutant. That is, the lead-containing alloys pose a threat to human health and environmental hygiene because lead finds its way into metallic vapor that generates in the steps of processing those alloys at high temperatures such as melting and casting. There is also a danger that lead contained in the water system metal fittings, valves, and so on made of those alloys will dissolve out into drinking water.

For these reasons, the United States and other advanced nations have been moving in recent years to tighten the standards for lead-containing copper alloys to drastically limit the permissible level of lead in copper alloys. In Japan, too, the use of lead-containing alloys has been increasingly restricted, and there has been a growing call for the development of free-cutting copper alloys with a low lead content.

SUMMARY OF THE INVENTION

It is an object of the present invention to provide a free-cutting copper alloy that contains an extremely small amount (0.02 to 0.4 percent by weight) of lead as a machinability-improving element, yet which is quite excellent in machinability, that can be used as safe substitute for the conventional easy-to-cut copper alloys that have a large lead content, and that presents no environmental hygienic problems while permitting the recycling of chippings, thus providing a timely answer to the mounting call for the restriction of lead-containing products.

It is an another object of the present invention to provide a free-cutting copper alloy that has high corrosion resistance coupled with excellent machinability and is suitable as basic material for cutting works, forgings, castings and others, thus having a very high practical value. The cutting works, forgings, castings, and so on, including city water faucets, water supply/drainage metal fittings, valves, stems, hot water supply pipe fittings, shaft and heat exchanger parts.

It is yet another object of the present invention to provide a free-cutting copper alloy, with a high strength and wear resistance coupled with an easy-to-cut property, that is suitable as basic material for the manufacture of cutting works, forgings, castings, and other uses requiring high strength and wear resistance such as, for example, bearings, bolts, nuts, bushes, gears, sewing machine parts, and hydraulic system parts, and which therefore is of great practical value.

It is a further object of the present invention to provide a free-cutting copper alloy with an excellent high-temperature oxidation resistance combined with an easy-to-cut property, which is suitable as basic material for the manufacture of cutting works, forgings, castings, and other uses where a high thermal oxidation resistance is essential, e.g. nozzles for kerosene oil and gas heaters, burner heads, and gas nozzles for hot-water dispensers, and which therefore has great practical value.

The objects of the present inventions are achieved by provision of the following copper alloys:

1. A free-cutting copper alloy with an excellent easy-to-cut feature which is composed of 69 to 79 percent, by weight, of copper, 2.0 to 4.0 percent, by weight, of silicon, 0.02 to 0.4 percent, by weight, of lead and the remaining percent, by weight, of zinc. For purpose of simplicity, this copper alloy will be hereinafter called the "first invention alloy."

Lead does not form a solid solution in the matrix but instead disperses in granular form to improve machinability. Silicon improves the easy-to-cut property by producing a gamma phase (in some cases, a kappa phase) in the structure of metal. Silicon and lead are the same in that they are effective in improving machinability, though they are quite different in their contribution to other properties of the alloy. On the basis of that recognition, silicon is added to the first invention alloy so as to bring about a high level of machinability meeting industrial requirements while making it possible to greatly reduce the lead content. That is, the first invention alloy is improved in machinability through formation of a gamma phase with the addition of silicon.

The addition of less than 2.0 percent by weight of silicon cannot form a gamma phase sufficient enough to secure industrially satisfactory machinability. With an increase in the addition of silicon, machinability improves. But with the addition of more than 4.0 percent by weight of silicon, machinability will not go up in proportion. The problem is, however, that silicon is high in melting point and low in specific gravity and also liable to oxidize. If unmixed silicon is fed into the furnace in the melting step, silicon will float on the molten metal and is oxidized into oxides of silicon (silicon oxide), hampering the production of a silicon-containing copper alloy. In producing the ingot of silicon-containing copper alloy, therefore, silicon is usually added in the form of a Cu—Si alloy, which boosts the production cost. Due also to the cost of making the alloy, it is not desirable to add silicon in a quantity exceeding the saturation point or plateau of machinability improvement, that is, 4.0 percent by weight. An experiment showed that when silicon is added in the amount of 2.0 to 4.0 percent by weight, it is desirable to hold the content of copper at 69 to 79 percent by weight in consideration of its relation to the content of zinc in order to maintain the intrinsic properties of the Cu—Zn alloy. For this reason, the first invention alloy is composed of 69 to 79 percent by weight of copper and 2.0 to 4.0 percent by weight of silicon, respectively. The addition of silicon improves not only the machinability but also the flow of the molten metal in casting, strength, wear resistance, resistance to stress corrosion cracking, and high-temperature oxidation resistance. Also, the ductility and de-zinc-ing corrosion resistance will be improved to some extent.

The addition of lead is set at 0.02 to 0.4 percent by weight for this reason. In the first invention alloy, a sufficient level of machinability is obtained by adding silicon that has the aforesaid effect even if the addition of lead is reduced. Yet, lead has to be added in an amount not smaller than 0.02 percent by weight if the alloy is to be superior to the conventional free-cutting copper alloy in machinability, while the addition of lead in an amount exceeding 0.4 percent by weight would have adverse effect, resulting in a rough surface condition, poor hot workability such as poor forging behavior, and low cold ductility. Meanwhile, it is expected that such a small content of not higher than 0.4 percent by weight will be able to clear the lead-related regulations however strictly they are to be stipulated in the advanced nations including Japan in the future. For that reason, the addition range of lead is set at 0.02 to 0.4 percent by weight in the first and also second to eleventh invention alloys which will be described later.

2. Another embodiment of the present invention is a free-cutting copper alloy also with an excellent easy-to-cut feature which is composed of 69 to 79 percent, by weight, of copper; 2.0 to 4.0 percent, by weight, of silicon; 0.02 to 0.4 percent, by weight, of lead; one additional element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc. This second copper alloy will be hereinafter called the "second invention alloy."

That is, the second invention alloy is composed of the first invention alloy and, in addition, one element selected from among 0.02 to 0.4 percent, by weight, of bismuth, 0.02 to 0.4 percent, by weight, of tellurium, and 0.02 to 0.4 percent, by weight, of selenium.

Bismuth, tellurium, and selenium, as with lead, do not form a solid solution with the matrix but disperse in granular form to enhance machinability. That makes up for the reduction of the lead content. The addition of any one of those elements along with silicon and lead could further improve the machinability beyond the level obtained from the addition of silicon and lead. From this finding, the second invention alloy was developed, in which one element selected from among bismuth, tellurium, and selenium is mixed. The addition of bismuth, tellurium, or selenium as well as silicon and lead can make the copper alloy so machinable that complicated forms can be freely cut out at a high speed. But no improvement in machinability can be realized from the addition of bismuth, tellurium, or selenium in an amount of less than 0.02 percent by weight. However, those elements are expensive as compared with copper. Even if the addition exceeds 0.4 percent by weight, the proportional improvement in machinability is so small that addition beyond that level does not pay off economically. What is more, if the addition is more than 0.4 percent by weight, the alloy will deteriorate in hot workability such as forgeability and cold workability such as ductility. While there might be a concern that heavy metals like bismuth would cause a problem similar to that of lead, a very small addition of less than 0.4 percent by weight is negligible and would present no particular problems. From those considerations, the second invention alloy is prepared with the addition of bismuth, tellurium, or selenium kept to 0.02 to 0.4 percent by weight. In this regard, it is desired to keep the combined content of lead and bismuth, tellurium, or selenium to not higher than 0.4 percent by weight. That is because if the combined content exceeds 0.4 percent by weight, if slightly, then there will begin a deterioration in hot workability and cold ductility and also there is fear that the form of chippings will change from (B) to (A) in FIG. 1. But the addition of bismuth, tellurium or selenium, which improves the machinability of the copper alloy though a mechanism different from that of silicon as mentioned above, would not affect the proper contents of copper and silicon. For this reason, the contents of copper and silicon in the second invention alloy are set at the same level as those in the first invention alloy.

3. Another embodiment of the present invention is a free-cutting copper alloy, also with an excellent easy-to-cut feature, which is composed of 70 to 80 percent, by weight, of copper; 1.8 to 3.5 percent, by weight, of silicon; 0.02 to 0.4 percent by weight, of lead; at least one element selected from among 0.3 to 3.5 percent, by weight, of tin, 1.0 to 3.5 percent, by weight, of aluminum, and 0.02 to 0.25 percent, by weight, of phosphorus; and the remaining percent, by weight, of zinc. This third copper alloy will be hereinafter called the "third invention alloy."

Tin works the same way as silicon. That is, if tin is added, a gamma phase will be formed and the machinability of the Cu—Zn alloy will be improved. For example, the addition of tin in the amount of 1.8 to 4.0 percent by weight would bring about a high machinability in the Cu—Zn alloy containing 58 to 70 percent, by weight, of copper, even if silicon is not present. Therefore, the addition of tin to the Cu—Si—Zn alloy could facilitate the formation of a gamma phase and further improve the machinability of the Cu—Si—Zn alloy. The gamma phase is formed with the addition of tin in the amount of 1.0 or more percent by weight and the formation reaches the saturation point at 3.5 percent, by weight, of tin. If tin exceeds 3.5 percent by weight, the ductility will drop instead. With the addition of tin in an amount less than 1.0 percent by weight, on the other hand, an insufficient gamma phase will be formed. If the addition is 0.3 or more percent by weight, then tin will be effective in uniformly dispersing the gamma phase formed by silicon. Through that effect of dispersing the gamma phase, too, the machinability is improved. In other words, the addition of tin in an amount not smaller than 0.3 percent by weight improves the machinability.

Aluminum is, too, effective in facilitating the formation of the gamma phase. The addition of aluminum together with or in place of tin could further improve the machinability of the Cu—Si—Zn alloy. Aluminum is also effective in improving the strength, wear resistance, and high-temperature oxidation resistance as well as the machinability and also in keeping down the specific gravity. If the machinability is to be improved at all, aluminum will have to be added in an amount of at least 1.0 percent by weight. But the addition of more than 3.5 percent by weight could not produce the proportional results. Instead, that could lower the ductility as is the case with tin.

As to phosphorus, it has no property of forming the gamma phase as tin and aluminum. But phosphorus works to uniformly disperse and distribute the gamma phase formed as a result of the addition of silicon alone or with tin or aluminum or both of them. That way, the machinability improvement through the formation of gamma phase is further enhanced. In addition to dispersing the gamma phase, phosphorus helps refine the crystal grains in the alpha phase in the matrix, improving hot workability and also strength and resistance to stress corrosion cracking. Furthermore, phosphorus substantially increases the flow of molten metal in casting. To produce such results, phosphorus will have to be added in an amount not smaller than 0.02 percent by weight. But if the addition exceeds 0.25 percent by weight, no proportional effect will be obtained. Instead, there would be a decrease in hot forging property and extrudability.

In consideration of those observations, the third invention alloy is improved in machinability by adding to the Cu—Si—Pb—Zn alloy (first invention alloy) at least one additional element selected from among 0.3 to 3.5 percent, by weight, of tin, 1.0 to 3.5 percent, by weight, of aluminum, and 0.02 to 0.25 percent, by weight, of phosphorus.

Tin, aluminum, and phosphorus act to improve machinability by forming a gamma phase or dispersing that phase, and work closely with silicon in promoting the improvement in machinability through the gamma phase. In the third invention alloy to which silicon is added along with tin, aluminum, or phosphorus, thus the addition of silicon is smaller than that in the second invention alloy to which is added bismuth, tellurium, or selenium, which replaces silicon of the first invention in improving machinability. That is, those elements bismuth, tellurium, and selenium contribute to improving the machinability, not acting on the gamma phase but dispersing in the form of grains in the matrix. Even if the addition of silicon is less than 2.0 percent by weight, silicon along with tin, aluminum, or phosphorus will be able to enhance the machinability to an industrially satisfactory level as long as the percentage of silicon is 1.8 or more percent by weight. But even if the addition of silicon is not larger than 4.0 percent by weight, adding tin, aluminum, or phosphorus together with silicon will saturate the effect of silicon in improving the machinability, when the silicon content exceeds 3.5 percent by weight. For this reason, the addition of silicon is set at 1.8 to 3.5 percent by weight in the third invention alloy. Also, in consideration of the addition amount of silicon and also the addition of tin, aluminum, or phosphorus, the content range of copper in this third invention alloy is slightly raised from the level in the second invention alloy and copper is properly set at 70 to 80 percent by weight.

4. A free-cutting copper alloy also with an excellent easy-to-cut feature which is composed of 70 to 80 percent, by weight, of copper; 1.8 to 3.5 percent, by weight, of silicon; 0.02 to 0.4 percent, by weight, of lead; at least one element selected from among 0.3 to 3.5 percent, by weight, of tin, 1.0 to 3.5 percent, by weight, of aluminum, and 0.02 to 0.25 percent, by weight, of phosphorus; one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc. This fourth copper alloy will be hereinafter called the "fourth invention alloy."

The fourth invention alloy has any one selected from among 0.02 to 0.4 percent, by weight, of bismuth, 0.02 to 0.4 percent, by weight, of tellurium, and 0.02 to 0.4 percent, by weight, of selenium in addition to the components in the third invention alloy. The grounds for mixing those additional elements and setting those amounts to be added are the same as given for the second invention alloy.

5. A free-cutting copper alloy with an excellent easy-to-cut feature and with a high corrosion resistance which is composed of 69 to 79 percent, by weight, of copper; 2.0 to 4.0 percent, by weight, of silicon; 0.02 to 0.4 percent, by weight, of lead; at least one element selected from among 0.3 to 3.5 percent, by weight, of tin, 0.02 to 0.25 percent, by weight, of phosphorus, 0.02 to 0.15 percent, by weight, of antimony, and 0.02 to 0.15 percent, by weight, of arsenic, and the remaining percent, by weight, of zinc. This fifth copper alloy will be hereinafter called the "fifth invention alloy."

The fifth invention alloy has, in addition to the first invention alloy, at least one element selected from among 0.3 to 3.5 percent, by weight, of tin, 0.02 to 0.25 percent, by weight, of phosphorus, 0.02 to 0.15 percent, by weight, of antimony, and 0.02 to 0.15 percent, by weight, of arsenic. Tin is effective in improving not only the machinability but also corrosion resistance properties (de-zinc-ification corrosion resistance) and forgeability. In other words, tin improves the corrosion resistance in the alpha phase matrix and, by dispersing the gamma phase, the corrosion resistance, forgeability, and stress corrosion cracking resistance. The fifth invention alloy is thus improved in corrosion resistance by the inclusion of tin and in machinability mainly by adding silicon. Therefore, the contents of silicon and copper in this alloy are set at the same as those in the first invention alloy. To raise the corrosion resistance and forgeability, on the other hand, tin would have to be added in the amount of at least 0.3 percent by weight. But even if the addition of tin exceeds 3.5 percent by weight, the corrosion resistance and forgeability will not improve in proportion to the increased amount of tin. Thus tin in excess of 3.5 percent would be uneconomical.

As described above, phosphorus disperses the gamma phase uniformly and at the same time refines the crystal grains in the alpha phase in the matrix, thereby improving the machinability and also the corrosion resistance properties (de-zinc-ification corrosion resistance), forgeability, stress corrosion cracking resistance, and mechanical strength. The fifth invention alloy is thus improved in corrosion resistance and other properties through the action of phosphorus and in machinability mainly by adding silicon. The addition of phosphorus in a very small quantity, that is, 0.02 or more percent by weight, could produce beneficial results. But the addition in more than 0.25 percent by weight would not be so effective as hoped from the quantity added. Rather, that would reduce the hot forgeability and extrudability.

As with phosphorus, antimony and arsenic in a very small quantity—0.02 or more percent by weight—are effective in improving the de-zinc-ification corrosion resistance and other properties. But their addition exceeding 0.15 percent by weight would not produce results in proportion to the excess quantity added. Rather, it would affect the hot forgeability and extrudability as does phosphorus applied in excessive amounts.

Those observations indicate that the fifth invention alloy is improved in machinability and also corrosion resistance and other properties by adding at least one element selected from among tin, phosphorus, antimony, and arsenic (which improve corrosion resistance) in quantities within the aforesaid limits in addition to the same quantities of copper and silicon as in the first invention copper alloy. In the fifth invention alloy, the additions of copper and silicon are set at 69 to 79 percent by weight and 2.0 to 4.0 percent by weight respectively—the same level as in the first invention alloy in which any other machinability improver than silicon and a small amount of lead is not added—because tin and phosphorus work mainly as corrosion resistance improvers like antimony and arsenic.

6. A free-cutting copper alloy also with an excellent easy-to-cut feature and with a high corrosion resistance which is composed of 69 to 79 percent, by weight, of copper; 2.0 to 4.0 percent, by weight, of silicon; 0.02 to 0.4 percent, by weight, of lead; at least one element selected from among 0.3 to 3.5 percent, by weight, of tin, 0.02 to 0.25 percent, by weight, of phosphorus, 0.02 to 0.15 percent, by weight, of antimony, and 0.02 to 0.15 percent, by weight, of arsenic; one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc. This sixth copper alloy will be herein after called the "sixth invention alloy."

The sixth invention alloy has any one element selected from among 0.02 to 0.4 percent, by weight, of bismuth, 0.02 to 0.4 percent, by weight, of tellurium, and 0.02 to 0.4 percent, by weight, of selenium in addition to the components in the fifth invention alloy. The machinability is improved by adding, in addition to silicon and lead, any one element selected from among bismuth, tellurium and selenium as in the second invention alloy and the corrosion resistance and other properties are raised by adding at least one selected from among tin, phosphorus, antimony and arsenic as in the fifth invention alloy. Therefore, the additions of copper, silicon, bismuth, tellurium and selenium are set at the same levels as those in the second invention alloy, while the additions of tin, phosphorus, antimony, and arsenic are adjusted to those in the fifth invention alloy.

7. A free-cutting copper alloy also with an excellent easy-to-cut feature and with an excellent high strength feature and high corrosion resistance which is composed of 62 to 78 percent, by weight, of copper; 2.5 to 4.5 percent, by weight, of silicon; 0.02 to 0.4 percent, by weight, of lead; at least one element selected from among 0.3 to 3.0 percent, by weight, of tin, 0.2 to 2.5 percent, by weight, of aluminum, and 0.02 to 0.25 percent, by weight, of phosphorus; and at least one element selected from among 0.7 to 3.5 percent, by weight, of manganese and 0.7 to 3.5 percent, by weight, of nickel; and the remaining percent, by weight, of zinc. The seventh copper alloy will be hereinafter called the "seventh invention alloy."

Manganese and nickel combine with silicon to form intermetallic compounds represented by $Mn_xSi_y$ or $Ni_xSi_y$, which are evenly precipitated in the matrix, thereby raising the wear resistance and strength. Therefore, the addition of manganese and nickel or either of the two would improve the high strength feature and wear resistance. Such effects will be exhibited if manganese and nickel are added in an amount not smaller than 0.7 percent by weight, respectively. But the saturation state is reached at 3.5 percent by weight, and even if the addition is increased beyond that, no proportional results will be obtained. The addition of silicon is set at 2.5 to 4.5 percent by weight to match the addition of manganese or nickel, taking into consideration the consumption to form intermetallic compounds with those elements.

It is also noted that tin, aluminum, and phosphorus help to reinforce the alpha phase in the matrix, thereby improving the machinability. Tin and phosphorus disperse the alpha and gamma phases, by which the strength, wear resistance, and also machinability are improved. Tin in an amount of 0.3 or more percent by weight is effective in improving the strength and machinability. But if the addition exceeds 3.0 percent by weight, the ductility will decrease. For this reason, the addition of tin is set at 0.3 to 3.0 percent by weight to raise the high strength feature and wear resistance in the seventh invention alloy, and also to enhance the machinability. Aluminum also contributes to improving the wear resistance and exhibits its effect of reinforcing the matrix when added in an amount of 0.2 or more percent by weight. But if the addition exceeds 2.5 percent by weight, there will be a decrease in ductility. Therefore, the addition of aluminum is set at 0.2 to 2.5 in consideration of improvement of machinability. Also, the addition of phosphorus disperses the gamma phase and at the same time pulverizes the crystal grains in the alpha phase in the matrix, thereby improving the hot workability and also the strength and wear resistance. Furthermore, it is very effective in improving the flow of molten metal in casting. Such results will be produced when phosphorus is added in an amount of 0.02 to 0.25 percent by weight. The content of copper is set at 62 to 78 percent by weight in the light of the addition of silicon and the property of manganese and nickel of combining with silicon.

8. A free-cutting copper alloy also with an excellent easy-to-cut feature and with an excellent high-temperature oxidation resistance which comprises 69 to 79 percent, by weight, of copper, 2.0 to 4.0 percent, by weight, of silicon, 0.02 to 0.4 percent, by weight, of lead, 0.1 to 1.5 percent, by weight, of aluminum, and 0.02 to 0.25 percent, by weight, of phosphorus, and the remaining percent, by weight, of zinc. The eighth copper alloy will be hereinafter called the "eighth invention alloy."

Aluminum is an element which improves strength, machinability, wear resistance, and also high-temperature oxidation resistance. Silicon, too, has a property of enhancing machinability, strength, wear resistance, resistance to stress corrosion cracking, and also high-temperature oxidation resistance. Aluminum works to raise the high-temperature oxidation resistance when it is used together with silicon in amounts not smaller than 0.1 percent by weight. But even if the addition of aluminum increases beyond 1.5 percent by weight, no proportional results can be expected. For this reason, the addition of aluminum is set at 0.1 to 1.5 percent by weight.

Phosphorus is added to enhance the flow of molten metal in casting. Phosphorus also works to improve the aforesaid machinability, de-zinc-ification corrosion resistance, and also high-temperature oxidation resistance, in addition to the flow of molten metal. Those effects are exhibited when phosphorus is added in amounts not smaller than 0.02 percent by weight. But even if phosphorus is used in amounts greater than 0.25 percent by weight, it will not result in a proportional increase in effect, rather weakening the alloy. Based upon this consideration, phosphorus is added to within a range of 0.02 to 0.25 percent by weight.

While silicon is added to improve machinability as mentioned above, it is also capable of improving the flow of molten metal like phosphorus. The effect of silicon in improving the flow of molten metal is exhibited when it is added in an amount not smaller than 2.0 percent by weight. The range of the addition for flow improvement overlaps that for improvement of the machinability. These taken into consideration, the addition of silicon is set to 2.0 to 4.0 percent by weight.

9. A free-cutting copper alloy also with excellent easy-to-cut feature coupled with a good high-temperature oxidation resistance which is composed of 69 to 79 percent, by weight, of copper; 2.0 to 4.0 percent, by weight, of silicon; 0.02 to 0.4 percent, by weight, of lead; 0.1 to 1.5 percent, by weight, of aluminum; 0.02 to 0.25 percent, by weight, of phosphorus; one element selected from among 0.02 to 0.4 percent, by weight, of bismuth, 0.02 to 0.4 percent, by weight, of tellurium, and 0.02 to 0.4 percent, by weight, of selenium; and the remaining percent, by weight, of zinc. The ninth copper alloy will be hereinafter called the "ninth invention alloy."

The ninth invention alloy contains one element selected from among 0.02 to 0.4 percent, by weight, of bismuth, 0.02 to 0.4 percent, by weight, of tellurium and 0.02 to 0.4 percent, by weight, of selenium in addition to the components of the eighth invention alloy. While a high-temperature oxidation resistance as good as in the eighth invention alloy is secured, the machinability is further improved by adding one element selected from among bismuth and other elements which are as effective as lead in raising the machinability, 10. A free-cutting copper alloy also with excellent easy-to-cut feature and a good high-temperature oxidation resistance which is composed of 69 to 79 percent, by weight, of copper; 2.0 to 4.0 percent, by weight, of silicon; 0.02 to 0.4 percent, by weight, of lead; 0.1 to 1.5 percent, by weight, of aluminum; 0.02 to 0.25 percent, by weight, of phosphorus; at least one selected from among 0.02 to 0.4 percent, by weight, of chromium and 0.02 to 0.4 percent, by weight, of titanium; and the remaining percent, by weight, of zinc. The tenth copper alloy will be hereinafter called the "tenth invention alloy."

Chromium and titanium are intended for improving the high-temperature oxidation resistance of the alloy. Good results can be expected especially when they are added together with aluminum to produce a synergistic effect. Those effects are exhibited when the addition is no less than 0.02 percent by weight, whether they are added alone or in combination. The saturation point is 0.4 percent by weight. For consideration of such observations, the tenth invention alloy has at least one element selected from among 0.02 to 0.4 percent by weight of chromium and 0.02 to 0.4 percent by weight of titanium in addition to the components of the eighth invention alloy and thus further improved over the eighth invention alloy with regard to high-temperature oxidation resistance.

11. A free-cutting copper alloy also with excellent easy-to-cut feature and a good high-temperature oxidation resistance which is composed of 69 to 79 percent, by weight, of copper; 2.0 to 4.0 percent, by weight, of silicon; 0.02 to 0.4 percent, by weight, of lead; 0.1 to 1.5 percent, by weight, of aluminum; 0.02 to 0.25 percent, by weight, of phosphorus; at least one element selected from among 0.02 to 0.4 percent, by weight, of chromium and 0.02 to 0.4 percent, by weight, of titanium; one element selected from among 0.02 to 0.4 percent, by weight, of bismuth, 0.02 to 0.4 percent, by weight, of tellurium and 0.02 to 0.4 percent, by weight, of selenium; and the remaining percent, by weight, of zinc. The eleventh copper alloy will be hereinafter called the "eleventh invention alloy."

The eleventh invention alloy contains any one element selected from among 0.02 to 0.4 percent, by weight, of bismuth, 0.02 to 0.4 percent, by weight, of tellurium, and 0.02 to 0.4 percent, by weight, of selenium, in addition to the components of the tenth invention alloy. While as high a high-temperature oxidation resistance as in the tenth invention alloy is secured, the eleventh invention alloy is further improved in machinability by adding one element selected from among bismuth and these other elements, which are as effective as lead in improving machinability.

12. A free-cutting copper alloy with further improved easy-to-cut properties, obtained by subjecting any one of the preceding respective invention alloys to a heat treatment for 30 minutes to 5 hours at 400 to 600° C. The twelfth copper alloy will be hereinafter called the "twelfth invention alloy."

The first to eleventh invention alloys contain machinability improving elements such as silicon and have an excellent machinability because of the addition of such elements. The effect of those machinability improving elements could be further enhanced by heat treatment. For example, the first to eleventh invention alloys which are high in copper content with gamma phase in small quantities and kappa phase in large quantities undergo a change in phase from the kappa phase to the gamma phase in a heat treatment. As a result, the gamma phase is finely dispersed and precipitated, and the machinability is improved. In the manufacturing process of castings, expanded metals and hot forgings in practice, the materials are often force-air-cooled or water cooled depending on the forging conditions, productivity after hot working (hot extrusion, hot forging, etc.), working environment, and other factors. In such cases, with the first to eleventh invention alloys, the alloys with a low content of copper in particular are rather low in the content of the gamma phase and contain beta phase. In a heat treatment, the beta phase changes into gamma phase, and the gamma phase is finely dispersed and precipitated, whereby the machinability is improved.

But a heat treatment temperature at less than 400° C. is not economical and practical in any case, because the aforesaid phase change will proceed slowly and much time will be needed. At temperatures over 600° C., on the other hand, the kappa phase will grow or the beta phase will appear, bringing about no improvement in machinability. From the practical viewpoint, therefore, it is desired to perform the heat treatment for 30 minutes to 5 hours at 400 to 600° C.

BRIEF DESCRIPTION OF THE DRAWING

FIG. 1 shows perspective views of cuttings formed in cutting a round bar of copper alloy by lathe.

DETAILED DESCRIPTION OF PREFERRED EMBODIMENTS

Example 1

As the first series of examples of the present invention, cylindrical ingots with compositions given in Tables 1 to 15, each 100 mm in outside diameter and 150 mm in length, were hot extruded into a round bar 15 mm in outside diameter at 750° C. to produce the following test pieces: first invention alloys Nos. 1001 to 1007, second invention alloys Nos. 2001 to 2006, third invention alloys Nos. 3001 to 3010, fourth invention alloys Nos. 4001 to 4021, fifth invention alloys Nos. 5001 to 5020, sixth invention alloys Nos. 6001 to 6045, seventh invention alloys Nos. 7001 to 7029, eight invention alloys Nos. 8001 to 8008, ninth invention alloys Nos. 9001 to 9006, tenth invention alloys Nos. 10001 to 10008, and eleventh invention alloys Nos. 11001 to 11011. Also, cylindrical ingots with the compositions given in Table 16, each 100 mm in outside diameter and 150 mm in length, were hot extruded into a round bar 15 mm in outside diameter at 750° C. to produce the following test pieces: twelfth invention alloys Nos. 12001 to 12004. That is, No. 12001 is an alloy test piece obtained by heat-treating an extruded test piece with the same composition as first invention alloy No. 1006 for 30 minutes at 580° C. No. 12002 is an alloy test piece obtained by heat-treating an extruded test piece with the same composition as No. 1006 for two hours at 450° C. No. 12003 is an alloy test piece obtained by heat-treating an extruded test piece with the same composition as first invention alloy No. 1007 under the same conditions as for No. 12001—for 30 minutes at 580° C.

No. 12004 is an alloy test piece obtained by heat-treating an extruded test piece with the same composition as No. 1007 under the same conditions as for No. 12002—for two hours at 450° C.

As comparative examples, cylindrical ingots with the compositions as shown in Table 17, each 100 mm in outside diameter and 150 mm in length, were hot extruded into a round bar 15 mm in outside diameter at 750° C. to obtain the following round extruded test pieces: Nos. 13001 to 13006 (hereinafter referred to as the "conventional alloys"). No. 13001 corresponds to the alloy "JIS C 3604," No. 13002 to the alloy "CDA C 36000," No. 13003 to the alloy "JIS C 3771," and No. 13004 to the alloy "CDA C 69800." No. 13005 corresponds to the alloy "JIS C 6191." This aluminum bronze is the most excellent of the expanded copper alloys under the JIS designations with regard to strength and wear resistance. No. 13006 corresponds to the navel brass alloy "JIS C 4622" and is the most excellent of the expanded copper alloys under the JIS designations with regard to corrosion resistance.

To study the machinability of the first to twelfth invention alloys in comparison with the conventional alloys, cutting tests were carried out. In the test, evaluations were made on the basis of cutting force, condition of chippings, and cut surface condition. The tests were conducted in this manner: The extruded test pieces thus obtained were cut on the circumferential surface by a lathe provided with a point noise straight tool at a rake angle of −8 degrees and at a cutting rate of 50 meters/minute, a cutting depth of 1.5 mm, and a feed of 0.11 mm/rev. Signals from a three-component dynamometer mounted on the tool were converted into electric voltage signals and recorded on a recorder. The signals were then converted into the cutting resistance. It is noted that while, to be perfectly exact, the amount of the cuffing resistance should be judged by three component forces—cutting force, feed force, and thrust force, the judgement was made on the basis of the cutting force (N) of the three component forces in the present example. The results are shown in Table 18 to Table 33.

Furthermore, the chips from the cutting work were examined and classified into four forms (A) to (D) as shown in FIG. 1. The results are enumerated in Table 18 to Table 33. In this regard, the chippings in the form of a spiral with three or more windings as (D) in FIG. 1 are difficult to process, that is, recover or recycle, and could cause trouble in cutting work as, for example, getting tangled with the tool and damaging the cut metal surface. Chippings in the form of a spiral arc from one with a half winding to one with two windings as shown in (C) in FIG. 1 do not cause such serous trouble as chippings in the form of a spiral with three or more windings, yet are not easy to remove and could get tangled with the tool or damage the cut metal surface. In contrast, chippings in the form of a fine needle as (A) in FIG. 1 or in the form of arc shaped pieces as (B) in FIG. 1 will not present such problems as mentioned above, are not as bulky as the chippings in (C) and (D), and are easy to process. But fine chipping as (A) still could creep in on the slide table of a machine tool such as a lathe and cause mechanical trouble, or could be dangerous because they could stick into the worker's finger, eye, or other body parts. Those factors taken into account, when judging machinability, the alloy with the chippings in (B) is the best, and the second best is that with the chippings in (A). Those with the chippings in (C) and (D) are not good. In Table 18 to Table 33, the alloys with the chippings shown in (B), (A), (C), and (D) are indicated by the symbols "◎", "○", "Δ", and "x" respectively.

In addition, the surface condition of the cut metal surface was checked after cutting work. The results are depicted in Table 18 to Table 33. In this regard, the commonly used basis for indicating the surface roughness is the maximum roughness (Rmax). While requirements are different depending on the field of application of articles made from the brass, brass alloys with Rmax<10 microns are generally considered excellent in machinability. The alloys with 10 microns≦Rmax<15 microns are judged as industrially acceptable. Brass alloys with Rmax≧15 microns are taken as poor in machinability. In Table 18 through Table 33, the alloys with Rmax<10 microns are marked "○", those with 10 microns≦Rmax<15 microns are indicated by "Δ", and those with Rmax≧15 microns are indicated by "x".

As is evident from the results of the cutting tests shown in Table 18 to Table 33, the following invention alloys are all equal to the conventional lead-containing alloys Nos. 13001 to 13003 in machinability: first invention alloys Nos. 1001 to 1007, second invention alloys Nos. 2001 to 2006, third invention alloys Nos. 3001 to 3010, fourth invention alloys Nos. 4001 to 4021, fifth invention alloys Nos. 5001 to 5020, sixth invention alloys Nos. 6001 to 6045, seventh invention alloys Nos. 7001 to 7029, eighth invention alloys Nos. 8001 to 8008, ninth invention alloys Nos. 9001 to 9006, tenth invention alloys Nos. 10001 to 10008, eleventh invention alloys Nos. 11001 to 11011, and twelfth invention alloys Nos. 12001 to 12004. Especially with regard to the form of chippings, those invention alloys compare favorably not only with conventional alloys Nos. 13004 to 13006, which have a lead content of not higher than 0.1 percent by weight, but also Nos. 13001 to 13003, which contain large quantities of lead. Also to be remarked is that twelfth invention alloys Nos. 12001 to 12004, which are obtained by heat-treating first invention alloys Nos. 1006 and 1007, are improved over the first invention alloys in machinability. It is understood that a proper heat treatment could likewise further enhance machinability of the first to eleventh invention alloys, depending upon the compositions of the alloys and other conditions.

In another series of tests, the first to twelfth invention alloys were examined in comparison with conventional alloys in hot workability and mechanical properties. For the purpose, hot compression and tensile tests were conducted in the following manner.

First, two test pieces, the first and second test pieces, in the same shape, 15 mm in outside diameter and 25 mm in length, were cut out of each extruded test piece obtained as described above. In hot compression tests, the first test piece was held for 30 minutes at 700° C., and then compressed at the compression rate of 70 percent in the axial direction to reduce the length from 25 mm to 7.5 mm. The surface condition after the compression (700° C. deformability) was visually evaluated. The results are given in Table 18 to Table 33. The evaluation of deformability was made by visually checking for cracks on the side of the test piece. In Table 18 to Table 33, the test pieces with no cracks found are marked "○", those with small cracks are indicated by "Δ", and those with large cracks are represented by the symbol "x".

The tensile strength, $N/mm^2$, and elongation, %, of the second test pieces was determined by the commonly practiced test method.

As the test results of the hot compression and tensile tests in Table 18 to Table 33 indicate, it was confirmed that the first to twelfth invention alloys are equal to or superior to the conventional alloys Nos. 13001 to 13004 and No. 13006 in hot workability and mechanical properties and are suitable for industrial use. The seventh invention alloys in particular have the same level of mechanical properties as the conventional alloy No. 13005, i.e. the aluminum bronze which is the most excellent in strength of the expanded copper alloys under the JIS designations, and thus clearly have a prominent high strength feature.

Furthermore, the first to six and eighth to twelfth invention alloys were put to de-zinc-ification corrosion and stress corrosion cracking tests in accordance with the test methods specified under "ISO 6509" and "JIS H 3250", respectively, to examine the corrosion resistance and resistance to stress corrosion cracking in comparison with conventional alloys.

In the de-zinc-ing corrosion test by the "ISO 6509" method, the test piece taken from each extruded test piece was imbedded laid in a phenolic resin material in such a way that the exposed test piece surface is perpendicular to the extrusion direction of the extruded test piece. The surface of the test piece was polished with emery paper No. 1200, and then ultrasonic-washed in pure water and dried. The test piece thus prepared was dipped in a 12.7 g/l aqueous solution of cupric chloride dihydrate ($CuCl_2.2H_2O$) 1.0% and left standing for 24 hours at 75° C. The test piece was taken out of the aqueous solution and the maximum depth of de-zinc-ing corrosion was determined. The measurements of the maximum de-zinc-ification corrosion depth are given in Table 18 to Table 25 and Table 28 to Table 33.

As is clear from the results of de-zinc-ification corrosion tests shown in Table 18 to Table 25 and Table 28 to Table 33, the first to fourth invention alloys and the eighth to twelfth invention alloys are excellent in corrosion resistance in comparison with the conventional alloys Nos. 13001 to 13003 which contain large amounts of lead. And it was confirmed that especially the fifth and sixth invention alloys which whose improvement in both machinability and corrosion resistance has been intended are very high in corrosion resistance in comparison with the conventional alloy No. 13006, a naval brass which is the most resistant to corrosion of all the expanded alloys under the JIS designations.

In the stress corrosion cracking tests in accordance with the test method described in "JIS H 3250," a 150-mm-long test piece was cut out from each extruded material. The test piece was bent with the center placed on an arc-shaped tester with a radius of 40 mm in such a way that one end forms an angle of 45 degrees with respect to the other end. The test piece thus subjected to a tensile residual stress was degreased and dried, and then placed in an ammonia environment in the desiccator with a 12.5% aqueous ammonia (ammonia diluted in the equivalent of pure water). To be exact, the test piece was held some 80 mm above the surface of aqueous ammonia in the desiccator. After the test piece was left standing in the ammonia environment for 2 hours, 8 hours, and 24 hours, the test piece was taken out from the desiccator, washed in sulfuric acid solution 10% and examined for cracks under 10× magnifications. The results are given in Table 18 to Table 25 and Table 28 to Table 33. In those tables, the alloys which developed clear cracks when held in the ammonia environment for two hours are marked "xx." The test pieces which had no cracks at 2 hours but were found clearly cracked in 8 hours are indicated by "x." The test pieces which had no cracks at 8 hours, but were found to clearly have cracks in 24 hours are identified by the symbol "Δ". The test pieces which were found to have no cracks at all in 24 hours are indicated by the symbol "○."

As is indicated by the results of the stress corrosion cracking test given in Table 18 to Table 25 and Table 28 to Table 33, it was confirmed that not only the fifth and sixth invention alloys whose improvement in both machinability and corrosion resistance has been intended but also the first to fourth invention alloys and the eighth to twelfth alloys in which nothing particular was done to improve corrosion resistance were both equal to the conventional alloy No. 13005, an aluminum bronze containing no zinc, in stress corrosion cracking resistance. Those invention alloys were superior in stress corrosion cracking resistance to the conventional naval brass alloy No. 13006, the best in corrosion resistance of all the expanded copper alloys under the JIS designations.

In addition, oxidation tests were carried out to study the high-temperature oxidation resistance of the eighth to eleventh invention alloys in comparison with conventional alloys.

Test pieces in the shape of a round bar with the surface cut to a outside diameter of 14 mm and the length cut to 30 mm were prepared from each of the following extruded materials: No. 8001 to No. 8008, No. 9001 to No. 9006, No. 10001 to No. 10008, No. 11001 to No. 11011, and No. 13001 to No. 13006. Each test piece was then weighed to measure the weight before oxidation. After that, the test piece was placed in a porcelain crucible and held in an electric furnace maintained at 500° C. At the passage of 100 hours, the test piece was taken out of the electric furnace and was weighed to measure the weight after oxidation. From the measurements before and after oxidation was calculated the increase in weight by oxidation. It is understood that the increase by oxidation is the amount, mg, of increase in weight by oxidation per 10 $cm^2$ of the surface area of the test piece, and is calculated by the equation: increase in weight by oxidation, mg/10 $cm^2$=(weight, mg, after oxidation−weight, mg, before oxidation)×(10 $cm^2$/surface area, $cm^2$, of test piece). The weight of each test piece increased after oxidation. The increase was brought about by high-temperature oxidation. Subjected to a high temperature, oxygen combines with copper, zinc, and silicon to form $Cu_2O$, ZnO, $SiO_2$, respectively. That is, oxygen adds to the weight. It can be said, therefore, that the alloys with a smaller weight increase due to oxidation are better in high-temperature oxidation resistance. The results obtained are shown in Table 28 to Table 31 and Table 33.

As is evident from the test results shown in Table 23 to Table 31 and Table 33, the eighth to eleventh invention alloys are equal, in regard to weight increase by oxidation, to the conventional alloy No. 13005, an aluminum bronze ranking high in resistance to high-temperature oxidation among the expanded copper alloys under the JIS designations, and are far smaller than any other conventional copper alloy. Thus, it was confirmed that the eighth to eleventh invention alloys are very excellent in machinability as well as resistance to high-temperature oxidation.

Example 2

As the second series of examples of the present invention, circular cylindrical ingots with compositions given in Tables 9 to 11, each 100 mm in outside diameter and 200 mm in length, were hot extruded into a round bar 35 mm in outside diameter at 700° C. to produce seventh invention alloys Nos. 7001*a* to 7029*a*. In parallel, circular cylindrical ingots with compositions given in Table 17, each 100 mm in outside diameter and 200 mm in length, were hot extruded into a round bar 35 mm in outside diameter at 700° C. to produce the following alloy test pieces: Nos. 13001*a* to 13006*a* as second comparative examples (hereinafter referred to as the "conventional alloys). It is noted that the alloys Nos. 7001*a* to 7029*a* and Nos. 13001*a* to 13006*a* are identical in composition with the aforesaid copper alloys Nos. 7001 to 7029 and Nos. 13001 to No. 13006, respectively.

Seventh invention alloys Nos. 7001*a* to 7029*a* were subjected to wear resistance tests in comparison with conventional alloys Nos. 13001*a* to 13006*a*.

The tests were carried out in this manner. Each extruded test piece thus obtained was cut on the circumferential surface, holed, and cut down into a ring-shaped test piece 32 mm in outside diameter and 10 mm in thickness (that is, the length in the axial direction). The test piece was then fitted and clamped on a rotatable shaft, and a roll 48 mm in diameter placed in parallel with the axis of the shaft was thrust against the test piece under a load of 50 kg. The roll was made of stainless steel having the JIS designation SUS 304. Then, the SUS 304 roll and the test piece put against the roll were rotated at the same number of revolutions/minute—209 r.p.m., with multipurpose gear oil being dropping on the circumferential surface of the test piece. When the number of revolutions reached 100,000, the SUS 304 roll and the test piece were stopped, and the weight difference between before rotation and after the end of rotation, that is, the loss of weight by wear, mg, was determined. It can be said that the alloys which are smaller in the loss of weight by wear are higher in wear resistance. The results are given in Tables 34 to 36.

As is clear from the wear resistance test results shown in Tables 34 to 36, the tests showed that those seventh invention alloys Nos. 7001*a* to 7029*a* were excellent in wear resistance as compared with not only the conventional alloys Nos. 13001*a* to 13004*a* and 13006*a* but also No. 13005*a*, which is an aluminum bronze most excellent in wear resistance among expanded copper designated in JIS. From comprehensive considerations of the test results including the tensile test results, it may safely be said the seventh invention alloys are excellent in machinability and also possess a high strength feature and wear resistance equal to or superior to the aluminum bronze which is the highest in wear resistance of all the expanded copper alloys under the JIS designations.

TABLE 1

| | alloy composition - (wt %) | | | |
|---|---|---|---|---|
| No. | Cu | Si | Pb | Zn |
| 1001 | 74.8 | 2.9 | 0.03 | remainder |
| 1002 | 74.1 | 2.7 | 0.21 | remainder |

TABLE 1-continued

| | alloy composition - (wt %) | | | |
|---|---|---|---|---|
| No. | Cu | Si | Pb | Zn |
| 1003 | 78.1 | 3.6 | 0.10 | remainder |
| 1004 | 70.6 | 2.1 | 0.36 | remainder |
| 1005 | 74.9 | 3.1 | 0.11 | remainder |
| 1006 | 69.3 | 2.3 | 0.05 | remainder |
| 1007 | 78.5 | 2.9 | 0.05 | remainder |

TABLE 2

| | alloy composition (wt %) | | | | | | |
|---|---|---|---|---|---|---|---|
| No. | Cu | Si | Pb | Bi | Te | Se | Zn |
| 2001 | 73.8 | 2.7 | 0.05 | 0.03 | | | remainder |
| 2002 | 69.9 | 2.0 | 0.33 | 0.27 | | | remainder |
| 2003 | 74.5 | 2.8 | 0.03 | | 0.31 | | remainder |
| 2004 | 78.0 | 3.6 | 0.12 | | 0.05 | | remainder |
| 2005 | 76.2 | 3.2 | 0.05 | | | 0.33 | remainder |
| 2006 | 72.9 | 2.6 | 0.24 | | | 0.06 | remainder |

TABLE 3

| | alloy composition (wt %) | | | | | | |
|---|---|---|---|---|---|---|---|
| No. | Cu | Si | Pb | Sn | Al | P | Zn |
| 3001 | 70.8 | 1.9 | 0.23 | 3.2 | | | remainder |
| 3002 | 74.5 | 3.0 | 0.05 | 0.4 | | | remainder |
| 3003 | 78.8 | 2.5 | 0.15 | | 3.4 | | remainder |
| 3004 | 74.9 | 2.7 | 0.09 | | 1.2 | | remainder |
| 3005 | 74.6 | 2.3 | 0.26 | 1.2 | 1.9 | | remainder |
| 3006 | 74.8 | 2.8 | 0.18 | | | 0.03 | remainder |
| 3007 | 76.5 | 3.3 | 0.04 | | | 0.21 | remainder |
| 3008 | 73.5 | 2.5 | 0.05 | 1.6 | | 0.05 | remainder |
| 3009 | 74.9 | 2.0 | 0.35 | | 2.7 | 0.13 | remainder |
| 3010 | 75.2 | 2.9 | 0.23 | 0.8 | 1.4 | 0.04 | remainder |

TABLE 4

| | alloy composition (wt %) | | | | | | | | | |
|---|---|---|---|---|---|---|---|---|---|---|
| No. | Cu | Si | Pb | Sn | Al | P | Bi | Te | Se | Zn |
| 4001 | 73.8 | 2.8 | 0.04 | 0.5 | | | 0.10 | | | remainder |
| 4002 | 74.5 | 2.6 | 0.11 | | 1.5 | | 0.04 | | | remainder |
| 4003 | 73.7 | 2.1 | 0.21 | 1.2 | 2.2 | | 0.03 | | | remainder |
| 4004 | 76.8 | 3.2 | 0.05 | | | 0.03 | 0.31 | | | remainder |
| 4005 | 74.1 | 2.6 | 0.07 | 1.4 | | 0.04 | 0.09 | | | remainder |
| 4006 | 75.5 | 1.9 | 0.32 | | 3.2 | 0.15 | 0.16 | | | remainder |
| 4007 | 74.8 | 2.8 | 0.10 | 0.7 | 1.2 | 0.05 | 0.05 | | | remainder |
| 4008 | 70.5 | 1.9 | 0.22 | 3.4 | | | | 0.03 | | remainder |
| 4009 | 79.1 | 2.7 | 0.15 | | 3.4 | | | 0.05 | | remainder |
| 4010 | 74.5 | 2.8 | 0.10 | | | 0.05 | | 0.05 | | remainder |
| 4011 | 77.3 | 3.3 | 0.07 | 0.4 | | 0.21 | | 0.31 | | remainder |
| 4012 | 76.8 | 2.8 | 0.05 | | 2.0 | 0.03 | | 0.13 | | remainder |
| 4013 | 74.5 | 2.6 | 0.18 | 1.4 | 2.1 | | | 0.21 | | remainder |
| 4014 | 74.0 | 2.5 | 0.20 | 2.1 | 1.1 | 0.10 | | 0.07 | | remainder |
| 4015 | 72.5 | 2.4 | 0.11 | 1.0 | | | | | 0.05 | remainder |
| 4016 | 76.1 | 2.5 | 0.07 | | 2.3 | | | | 0.10 | remainder |
| 4017 | 76.4 | 2.7 | 0.05 | 0.6 | 3.1 | | | | 0.22 | remainder |
| 4018 | 74.0 | 2.5 | 0.23 | | | 0.22 | | | 0.03 | remainder |
| 4019 | 71.2 | 2.2 | 0.11 | 2.8 | | 0.05 | | | 0.30 | remainder |
| 4020 | 75.3 | 2.7 | 0.22 | | 1.4 | 0.03 | | | 0.05 | remainder |
| 4021 | 74.1 | 2.5 | 0.05 | 2.4 | 1.2 | 0.07 | | | 0.07 | remainder |

TABLE 5

| No. | alloy composition (wt %) | | | | | | | |
|---|---|---|---|---|---|---|---|---|
| | Cu | Si | Pb | Sn | P | Sb | As | Zn |
| 5001 | 74.3 | 2.9 | 0.05 | 0.4 | | | | remainder |
| 5002 | 69.8 | 2.1 | 0.31 | 3.1 | | | | remainder |
| 5003 | 74.8 | 2.8 | 0.03 | | 0.08 | | | remainder |
| 5004 | 78.2 | 3.4 | 0.16 | | 0.21 | | | remainder |
| 5005 | 74.9 | 3.1 | 0.09 | | | 0.07 | | remainder |
| 5006 | 72.2 | 2.4 | 0.25 | | | | 0.13 | remainder |
| 5007 | 73.5 | 2.5 | 0.18 | 2.2 | 0.04 | | | remainder |
| 5008 | 77.0 | 3.3 | 0.06 | 0.7 | 0.15 | | | remainder |
| 5009 | 76.4 | 3.6 | 0.12 | 1.2 | | | | remainder |
| 5010 | 71.4 | 2.3 | 0.26 | 2.6 | | 0.03 | | remainder |
| 5011 | 77.3 | 3.4 | 0.17 | 0.5 | | 0.14 | | remainder |

TABLE 5-continued

| No. | alloy composition (wt %) | | | | | | | |
|---|---|---|---|---|---|---|---|---|
| | Cu | Si | Pb | Sn | P | Sb | As | Zn |
| 5012 | 74.8 | 2.8 | 0.07 | 1.4 | | | 0.03 | remainder |
| 5013 | 74.5 | 2.7 | 0.05 | | 0.03 | 0.12 | | remainder |
| 5014 | 76.1 | 3.1 | 0.14 | | 0.18 | 0.03 | | remainder |
| 5015 | 73.9 | 2.5 | 0.08 | | 0.07 | | 0.05 | remainder |
| 5016 | 74.5 | 2.8 | 0.07 | | | 0.08 | 0.04 | remainder |
| 5017 | 77.3 | 3.1 | 0.12 | 1.5 | 0.13 | 0.05 | | remainder |
| 5018 | 72.8 | 2.4 | 0.18 | 0.7 | | 0.03 | 0.09 | remainder |
| 5019 | 74.2 | 2.7 | 0.07 | 0.5 | 0.11 | | 0.10 | remainder |
| 5020 | 74.6 | 2.8 | 0.05 | 0.9 | 0.07 | 0.05 | 0.03 | remainder |

TABLE 6

| No. | alloy composition (wt %) | | | | | | | | | | |
|---|---|---|---|---|---|---|---|---|---|---|---|
| | Cu | Si | Pb | Bi | Te | Se | Sn | P | Sb | As | Zn |
| 6001 | 70.7 | 2.3 | 0.17 | 0.05 | | | 2.8 | | | | remainder |
| 6002 | 74.6 | 2.5 | 0.08 | 0.03 | | | 0.7 | 0.06 | | | remainder |
| 6003 | 78.0 | 3.7 | 0.05 | 0.34 | | | 0.4 | | 0.05 | | remainder |
| 6004 | 69.5 | 2.1 | 0.32 | 0.02 | | | 3.3 | | | 0.03 | remainder |
| 6005 | 76.8 | 2.8 | 0.03 | 0.07 | | | 0.8 | 0.21 | 0.02 | | remainder |
| 6006 | 74.2 | 2.7 | 0.18 | 0.10 | | | 0.5 | 0.03 | | 0.13 | remainder |
| 6007 | 76.1 | 3.2 | 0.12 | 0.05 | | | 1.7 | | 0.12 | 0.02 | remainder |
| 6008 | 75.3 | 2.8 | 0.20 | 0.16 | | | 1.3 | 0.10 | 0.03 | 0.05 | remainder |
| 6009 | 77.0 | 3.1 | 0.14 | 0.06 | | | | 0.21 | | | remainder |
| 6010 | 72.5 | 2.5 | 0.07 | 0.09 | | | | 0.05 | 0.03 | | remainder |
| 6011 | 74.7 | 2.9 | 0.10 | 0.32 | | | | 0.14 | | 0.10 | remainder |
| 6012 | 71.4 | 2.3 | 0.25 | 0.14 | | | | 0.07 | 0.03 | 0.02 | remainder |
| 6013 | 74.7 | 3.0 | 0.13 | 0.05 | | | | | 0.12 | | remainder |
| 6014 | 77.2 | 3.2 | 0.27 | 0.23 | | | | | 0.07 | 0.04 | remainder |
| 6015 | 74.0 | 2.8 | 0.07 | 0.03 | | | | | | 0.03 | remainder |
| 6016 | 69.8 | 2.1 | 0.22 | | 0.17 | | 3.2 | | | | remainder |
| 6017 | 73.8 | 2.9 | 0.15 | | 0.03 | | 1.6 | 0.07 | | | remainder |
| 6018 | 75.8 | 2.8 | 0.08 | | 0.06 | | 0.4 | | 0.03 | | remainder |
| 6019 | 71.2 | 2.3 | 0.15 | | 0.07 | | 2.5 | | | 0.07 | remainder |
| 6020 | 72.0 | 2.6 | 0.12 | | 0.04 | | 0.9 | 0.03 | 0.05 | | remainder |

TABLE 7

| No. | alloy composition (wt %) | | | | | | | | | | |
|---|---|---|---|---|---|---|---|---|---|---|---|
| | Cu | Si | Pb | Bi | Te | Se | Sn | P | Sb | As | Zn |
| 6021 | 76.8 | 2.9 | 0.20 | | 0.30 | | 0.8 | 0.17 | | 0.03 | remainder |
| 6022 | 78.3 | 3.2 | 0.15 | | 0.36 | | 0.4 | | 0.06 | 0.14 | remainder |
| 6023 | 73.4 | 2.3 | 0.12 | | 0.06 | | 2.7 | 0.02 | 0.11 | 0.03 | remainder |
| 6024 | 74.6 | 2.8 | 0.05 | | 0.08 | | | 0.19 | | | remainder |
| 6025 | 78.5 | 3.7 | 0.22 | | 0.25 | | | 0.23 | 0.03 | | remainder |
| 6026 | 74.9 | 2.9 | 0.16 | | 0.05 | | | 0.05 | | 0.10 | remainder |
| 6027 | 73.8 | 2.5 | 0.07 | | 0.03 | | | 0.06 | 0.02 | 0.04 | remainder |
| 6028 | 74.8 | 2.6 | 0.12 | | 0.02 | | | | 0.12 | | remainder |
| 6029 | 74.2 | 2.8 | 0.37 | | 0.10 | | | | 0.11 | 0.02 | remainder |
| 6030 | 76.3 | 3.2 | 0.08 | | 0.05 | | | | | 0.07 | remainder |
| 6031 | 70.8 | 2.4 | 0.11 | | | 0.05 | 2.6 | | | | remainder |
| 6032 | 74.6 | 3.0 | 0.25 | | | 0.32 | 0.6 | 0.06 | | | remainder |
| 6033 | 75.0 | 2.8 | 0.03 | | | 0.12 | 0.3 | | 0.13 | | remainder |
| 6034 | 73.5 | 2.8 | 0.12 | | | 0.07 | 1.0 | | | 0.11 | remainder |
| 6035 | 78.0 | 3.3 | 0.07 | | | 0.03 | 0.5 | 0.16 | 0.02 | | remainder |
| 6036 | 72.4 | 2.5 | 0.13 | | | 0.05 | 3.1 | 0.03 | | 0.05 | remainder |
| 6037 | 78.0 | 2.8 | 0.18 | | | 0.20 | 1.7 | | 0.08 | 0.02 | remainder |
| 6038 | 76.5 | 3.1 | 0.10 | | | 0.11 | 1.7 | 0.03 | 0.03 | 0.04 | remainder |
| 6039 | 71.9 | 2.4 | 0.12 | | | 0.17 | | 0.04 | | | remainder |
| 6040 | 77.0 | 3.5 | 0.03 | | | 0.35 | | 0.23 | 0.03 | | remainder |

TABLE 8

| | alloy composition (wt %) | | | | | | | | | | |
|---|---|---|---|---|---|---|---|---|---|---|---|
| No. | Cu | Si | Pb | Bi | Te | Se | Sn | P | Sb | As | Zn |
| 6041 | 74.7 | 2.9 | 0.07 | | | 0.12 | | 0.06 | | 0.03 | remainder |
| 6042 | 72.8 | 2.5 | 0.20 | | | 0.06 | | | 0.03 | | remainder |
| 6043 | 78.0 | 3.7 | 0.33 | | | 0.15 | | | 0.02 | 0.10 | remainder |
| 6044 | 74.0 | 2.8 | 0.12 | | | 0.05 | | | | 0.08 | remainder |
| 6045 | 76.1 | 3.1 | 0.05 | | | 0.07 | | 0.03 | 0.09 | 0.03 | remainder |

TABLE 9

| | alloy composition (wt %) | | | | | | | | |
|---|---|---|---|---|---|---|---|---|---|
| No. | Cu | Si | Pb | Sn | Al | P | Mn | Ni | Zn |
| 7001 | 67.0 | 3.8 | 0.04 | 1.6 | | | 3.2 | | remainder |
| 7001a | | | | | | | | | |
| 7002 | 69.3 | 4.2 | 0.15 | 0.4 | | | | 2.2 | remainder |
| 7002a | | | | | | | | | |
| 7003 | 63.8 | 2.6 | 0.33 | 2.8 | | | 0.9 | | remainder |
| 7003a | | | | | | | | | |
| 7004 | 66.5 | 3.4 | 0.07 | 1.5 | | | 2.0 | | remainder |
| 7004a | | | | | | | | | |
| 7005 | 67.2 | 3.6 | 0.10 | 0.9 | | | 1.8 | 0.9 | remainder |
| 7005a | | | | | | | | | |
| 7006 | 63.0 | 2.7 | 0.27 | 2.7 | 1.2 | | 2.1 | | remainder |
| 7006a | | | | | | | | | |
| 7007 | 68.7 | 3.4 | 0.05 | 1.4 | 1.3 | | 0.9 | | remainder |
| 7007a | | | | | | | | | |
| 7008 | 70.6 | 4.1 | 0.03 | 0.5 | 1.6 | | 3.4 | | remainder |
| 7008a | | | | | | | | | |
| 7009 | 67.8 | 3.6 | 0.12 | 2.6 | 2.1 | | | 3.3 | remainder |
| 7009a | | | | | | | | | |
| 7010 | 68.4 | 3.5 | 0.06 | 0.4 | 0.3 | | | 1.8 | remainder |
| 7010a | | | | | | | | | |

TABLE 10

| | alloy Composition (wt %) | | | | | | | | |
|---|---|---|---|---|---|---|---|---|---|
| No. | Cu | Si | Pb | Sn | Al | P | Mn | Ni | Zn |
| 7011 | 73.9 | 4.4 | 0.17 | 1.2 | 1.7 | | 0.8 | 1.5 | remainder |
| 7011a | | | | | | | | | |
| 7012 | 65.5 | 2.9 | 0.20 | 1.5 | 1.0 | 0.12 | 2.3 | | remainder |
| 7012a | | | | | | | | | |
| 7013 | 66.1 | 3.3 | 0.08 | 1.8 | 1.1 | 0.03 | | 2.6 | remainder |
| 7013a | | | | | | | | | |
| 7014 | 70.3 | 3.9 | 0.15 | 1.0 | 1.4 | 0.21 | 1.8 | 1.2 | remainder |
| 7014a | | | | | | | | | |
| 7015 | 66.8 | 3.7 | 0.20 | 2.6 | | 0.14 | 2.7 | | remainder |
| 7015a | | | | | | | | | |
| 7016 | 69.0 | 4.0 | 0.07 | 0.5 | | 0.20 | | 3.2 | remainder |
| 7016a | | | | | | | | | |
| 7017 | 64.5 | 2.9 | 0.19 | 1.8 | | 0.05 | 1.5 | 0.8 | remainder |
| 7017a | | | | | | | | | |
| 7018 | 72.4 | 3.5 | 0.08 | | 1.5 | | 1.1 | | remainder |
| 7018a | | | | | | | | | |
| 7019 | 69.2 | 3.9 | 0.03 | | 0.4 | | 3.1 | | remainder |
| 7019a | | | | | | | | | |
| 7020 | 76.6 | 4.3 | 0.14 | | 2.3 | | 1.9 | | remainder |
| 7020a | | | | | | | | | |

TABLE 11

| | alloy composition (wt %) | | | | | | | | |
|---|---|---|---|---|---|---|---|---|---|
| No. | Cu | Si | Pb | Sn | Al | P | Mn | Ni | Zn |
| 7021 | 75.0 | 4.2 | 0.19 | | 1.7 | | | 2.1 | remainder |
| 7021a | | | | | | | | | |

TABLE 11-continued

| | alloy composition (wt %) | | | | | | | | |
|---|---|---|---|---|---|---|---|---|---|
| No. | Cu | Si | Pb | Sn | Al | P | Mn | Ni | Zn |
| 7022 | 72.3 | 3.7 | 0.05 | | 1.4 | | 1.1 | 0.8 | remainder |
| 7022a | | | | | | | | | |
| 7023 | 64.5 | 3.8 | 0.35 | | 0.3 | | 2.0 | 2.3 | remainder |
| 7023a | | | | | | | | | |
| 7024 | 75.8 | 3.9 | 0.05 | | 2.7 | 0.04 | 1.0 | | remainder |
| 7024a | | | | | | | | | |
| 7025 | 70.1 | 3.5 | 0.06 | | 1.2 | 0.23 | | 3.0 | remainder |
| 7025a | | | | | | | | | |
| 7026 | 67.2 | 2.8 | 0.22 | | 1.8 | 0.14 | 2.2 | 0.9 | remainder |
| 7026a | | | | | | | | | |
| 7027 | 70.2 | 3.8 | 0.11 | | | 0.03 | 3.2 | | remainder |
| 7027a | | | | | | | | | |
| 7028 | 75.9 | 4.4 | 0.03 | | | 0.20 | | 1.1 | remainder |
| 7028a | | | | | | | | | |
| 7029 | 66.0 | 3.0 | 0.18 | | | 0.12 | 1.0 | 2.1 | remainder |
| 7029a | | | | | | | | | |

TABLE 12

| | alloy composition (wt %) | | | | | |
|---|---|---|---|---|---|---|
| No. | Cu | Si | Pb | Al | P | Zn |
| 8001 | 74.5 | 2.9 | 0.16 | 0.2 | 0.05 | remainder |
| 8002 | 76.0 | 2.7 | 0.03 | 1.2 | 0.21 | remainder |
| 8003 | 76.3 | 3.0 | 0.35 | 0.6 | 0.12 | remainder |
| 8004 | 69.9 | 2.1 | 0.27 | 0.3 | 0.03 | remainder |
| 8005 | 71.5 | 2.3 | 0.12 | 0.8 | 0.10 | remainder |
| 8006 | 78.1 | 3.6 | 0.05 | 0.2 | 0.13 | remainder |
| 8007 | 77.7 | 3.4 | 0.18 | 1.4 | 0.06 | remainder |
| 8008 | 77.5 | 3.5 | 0.03 | 0.9 | 0.15 | remainder |

TABLE 13

| | alloy composition (wt %) | | | | | | | | |
|---|---|---|---|---|---|---|---|---|---|
| No. | Cu | Si | Pb | Al | P | Bi | Te | Se | Zn |
| 9001 | 74.8 | 2.8 | 0.05 | 0.6 | 0.07 | 0.03 | | | remainder |
| 9002 | 76.6 | 2.9 | 0.12 | 0.9 | 0.03 | 0.32 | | | remainder |
| 9003 | 72.3 | 2.2 | 0.32 | 0.5 | 0.12 | | 0.25 | | remainder |
| 9004 | 77.2 | 3.0 | 0.07 | 1.4 | 0.21 | | 0.05 | | remainder |
| 9005 | 78.1 | 3.6 | 0.16 | 0.3 | 0.15 | | | 0.29 | remainder |
| 9006 | 74.5 | 2.6 | 0.05 | 0.6 | 0.08 | | | 0.07 | remainder |

TABLE 14

| | alloy composition (wt %) | | | | | | | |
|---|---|---|---|---|---|---|---|---|
| No. | Cu | Si | Pb | Al | P | Cr | Ti | Zn |
| 10001 | 76.0 | 2.8 | 0.12 | 0.7 | 0.13 | | 0.21 | remainder |
| 10002 | 75.0 | 3.0 | 0.03 | 0.2 | 0.05 | | 0.03 | remainder |
| 10003 | 78.3 | 3.4 | 0.06 | 1.3 | 0.20 | | 0.34 | remainder |
| 10004 | 69.6 | 2.1 | 0.25 | 0.8 | 0.03 | | 0.17 | remainder |

TABLE 14-continued

| | alloy composition (wt %) | | | | | | | |
|---|---|---|---|---|---|---|---|---|
| No. | Cu | Si | Pb | Al | P | Cr | Ti | Zn |
| 10005 | 77.5 | 3.6 | 0.12 | 0.7 | 0.15 | 0.23 | | remainder |
| 10006 | 71.8 | 2.2 | 0.32 | 1.2 | 0.08 | 0.32 | | remainder |
| 10007 | 74.7 | 2.7 | 0.1 | 0.6 | 0.10 | 0.03 | | remainder |
| 10008 | 75.4 | 2.9 | 0.03 | 0.3 | 0.06 | 0.12 | 0.08 | remainder |

TABLE 15

| | alloy composition (wt %) | | | | | | | | | | |
|---|---|---|---|---|---|---|---|---|---|---|---|
| No. | Cu | Si | Pb | Al | Bi | Te | Se | P | Cr | Ti | Zn |
| 11001 | 76.5 | 2.9 | 0.08 | 0.9 | 0.03 | | | 0.12 | 0.03 | | remainder |
| 11002 | 70.4 | 2.2 | 0.32 | 0.5 | 0.21 | | | 0.03 | 0.18 | | remainder |
| 11003 | 78.2 | 3.5 | 0.16 | 1.3 | 0.35 | | | 0.20 | | 0.34 | remainder |
| 11004 | 73.9 | 2.7 | 0.03 | 0.3 | 0.11 | | | 0.06 | | 0.22 | remainder |
| 11005 | 75.8 | 3.0 | 0.06 | 0.6 | 0.08 | | | 0.11 | 0.10 | 0.07 | remainder |
| 11006 | 71.6 | 2.1 | 0.24 | 1.0 | | 0.21 | | 0.04 | 0.32 | | remainder |
| 11007 | 73.8 | 2.4 | 0.10 | 1.1 | | 0.04 | | 0.07 | | 0.03 | remainder |
| 11008 | 75.5 | 3.0 | 0.13 | 0.2 | | 0.36 | | 0.12 | 0.06 | 0.14 | remainder |
| 11009 | 77.7 | 3.2 | 0.03 | 1.4 | | | 0.17 | 0.23 | 0.23 | | remainder |
| 11010 | 75.0 | 2.7 | 0.15 | 0.7 | | | 0.03 | 0.03 | | 0.12 | remainder |
| 11011 | 72.9 | 2.4 | 0.20 | 0.8 | | | 0.31 | 0.06 | 0.09 | 0.05 | remainder |

TABLE 16

| | alloy composition (wt %) | | | | heat treatment | |
|---|---|---|---|---|---|---|
| No. | Cu | Si | Pb | Zn | temperature | time |
| 12001 | 69.3 | 2.3 | 0.05 | remainder | 580° C. | 30 min. |
| 12002 | 69.3 | 2.3 | 0.05 | remainder | 450° C. | 2 hr. |
| 12003 | 78.5 | 2.9 | 0.05 | remainder | 580° C. | 30 min. |
| 12004 | 78.5 | 2.9 | 0.05 | remainder | 450° C. | 2 hr. |

TABLE 17

| | alloy composition (wt %) | | | | | | | | |
|---|---|---|---|---|---|---|---|---|---|
| No. | Cu | Si | Pb | Sn | Al | Mn | Ni | Fe | Zn |
| 13001 | 58.8 | | 3.1 | 0.2 | | | | 0.2 | remainder |
| 13001a | | | | | | | | | |
| 13002 | 61.4 | | 3.0 | 0.2 | | | | 0.2 | remainder |
| 13002a | | | | | | | | | |
| 13003 | 59.1 | | 2.0 | 0.2 | | | | 0.2 | remainder |

TABLE 17-continued

| | alloy composition (wt %) | | | | | | | | |
|---|---|---|---|---|---|---|---|---|---|
| No. | Cu | Si | Pb | Sn | Al | Mn | Ni | Fe | Zn |
| 13003a | | | | | | | | | |
| 13004 | 69.2 | 1.2 | 0.1 | | | | | | remainder |
| 13004a | | | | | | | | | |
| 13005 | remainder | | | | 9.8 | 1.1 | 1.2 | 3.9 | |
| 13005a | | | | | | | | | |
| 13006 | 61.8 | | 0.1 | 1.0 | | | | | remainder |
| 13006a | | | | | | | | | |

TABLE 18

| | machinability | | | corrosion resistance | | mechanical properties | | stress resistance |
|---|---|---|---|---|---|---|---|---|
| | condition | | | maximum | | | | |
| No. | form of chippings | of cut surface | cutting force (N) | depth of corrosion (μm) | hot workability 700° C. deformability | tensile strength (N/mm$^2$) | elongation (%) | corrosion cracking resistance |
| 1001 | ◎ | ○ | 117 | 160 | ○ | 533 | 35 | ○ |
| 1002 | ◎ | ○ | 114 | 170 | ○ | 520 | 32 | ○ |
| 1003 | ◎ | ○ | 119 | 140 | Δ | 575 | 36 | ○ |
| 1004 | ◎ | ○ | 118 | 220 | Δ | 490 | 30 | Δ |
| 1005 | ◎ | ○ | 114 | 170 | ○ | 546 | 34 | ○ |
| 1006 | Δ | ○ | 126 | 230 | ○ | 504 | 32 | Δ |
| 1007 | ◎ | Δ | 127 | 170 | Δ | 515 | 44 | ○ |

TABLE 19

| | machinability | | | corrosion resistance | | mechanical properties | | stress resistance |
|---|---|---|---|---|---|---|---|---|
| | condition | | | maximum | | | | |
| No. | form of chippings | of cut surface | cutting force (N) | depth of corrosion (μm) | hot workability 700° C. deformability | tensile strength (N/mm$^2$) | elongation (%) | corrosion cracking resistance |
| 2001 | ◎ | ○ | 116 | 180 | ○ | 510 | 33 | ○ |
| 2002 | ◎ | ○ | 115 | 230 | Δ | 475 | 28 | Δ |
| 2003 | ◎ | ○ | 115 | 160 | Δ | 540 | 32 | ○ |
| 2004 | ◎ | ○ | 117 | 150 | Δ | 576 | 35 | ○ |
| 2005 | ◎ | ○ | 116 | 140 | Δ | 543 | 37 | ○ |
| 2006 | ◎ | ○ | 114 | 180 | Δ | 502 | 32 | ○ |

TABLE 20

| | machinability | | | corrosion resistance | | mechanical properties | | stress resistance |
|---|---|---|---|---|---|---|---|---|
| | condition | | | maximum | | | | |
| No. | form of chippings | of cut surface | cutting force (N) | depth of corrosion (μm) | hot workability 700° C. deformability | tensile strength (N/mm$^2$) | elongation (%) | corrosion cracking resistance |
| 3001 | ◎ | ○ | 120 | 30 | ○ | 542 | 23 | ○ |
| 3002 | ◎ | ○ | 117 | 70 | ○ | 550 | 30 | ○ |
| 3003 | ◎ | ○ | 119 | 110 | Δ | 565 | 34 | ○ |
| 3004 | ◎ | ○ | 118 | 140 | ○ | 532 | 35 | ○ |
| 3005 | ◎ | ○ | 119 | 50 | Δ | 547 | 27 | ○ |
| 3006 | ◎ | ○ | 115 | 30 | ○ | 538 | 34 | ○ |
| 3007 | ◎ | ○ | 117 | <5 | Δ | 562 | 36 | ○ |
| 3008 | ◎ | ○ | 119 | <5 | ○ | 529 | 26 | ○ |
| 3009 | ◎ | ○ | 118 | <5 | Δ | 518 | 30 | ○ |
| 3010 | ◎ | ○ | 116 | <5 | ○ | 555 | 28 | ○ |

TABLE 21

| | machinability | | | corrosion resistance | | mechanical properties | | stress resistance |
|---|---|---|---|---|---|---|---|---|
| | condition | | | maximum | | | | |
| No. | form of chippings | of cut surface | cutting force (N) | depth of corrosion (μm) | hot workability 700° C. deformability | tensile strength (N/mm$^2$) | elongation (%) | corrosion cracking resistance |
| 4001 | ◎ | ○ | 119 | 70 | ○ | 535 | 30 | ○ |
| 4002 | ◎ | ○ | 116 | 120 | ○ | 547 | 33 | ○ |
| 4003 | ◎ | ○ | 118 | 60 | Δ | 539 | 26 | ○ |
| 4004 | ○ | ○ | 113 | 30 | Δ | 550 | 31 | ○ |
| 4005 | ◎ | ○ | 117 | <5 | ○ | 534 | 27 | ○ |
| 4006 | ◎ | ○ | 118 | <5 | Δ | 542 | 30 | ○ |
| 4007 | ○ | ○ | 116 | <5 | ○ | 563 | 32 | ○ |
| 4008 | ◎ | ○ | 120 | 40 | Δ | 507 | 25 | ○ |
| 4009 | ◎ | ○ | 117 | 110 | Δ | 572 | 36 | ○ |
| 4010 | ◎ | ○ | 115 | 10 | ○ | 524 | 33 | ○ |
| 4011 | ◎ | ○ | 116 | <5 | Δ | 580 | 31 | ○ |
| 4012 | ◎ | ○ | 114 | 20 | ○ | 575 | 34 | ○ |
| 4013 | ○ | ○ | 115 | 50 | Δ | 588 | 28 | ○ |
| 4014 | ◎ | ○ | 117 | <5 | ○ | 543 | 26 | ○ |
| 4015 | ◎ | ○ | 117 | 60 | ○ | 501 | 27 | ○ |
| 4016 | ◎ | ○ | 116 | 130 | Δ | 539 | 32 | ○ |
| 4017 | ◎ | ○ | 118 | 50 | ○ | 574 | 34 | ○ |
| 4018 | ◎ | ○ | 115 | <5 | ○ | 506 | 30 | ○ |
| 4019 | ◎ | ○ | 118 | <5 | ○ | 523 | 28 | ○ |
| 4020 | ◎ | ○ | 115 | 20 | Δ | 548 | 32 | ○ |
| 4021 | ◎ | ○ | 118 | <5 | ○ | 553 | 27 | ○ |

TABLE 22

| | machinability | | | corrosion resistance maximum | hot | mechanical properties | | stress resistance |
|---|---|---|---|---|---|---|---|---|
| No. | form of chippings | condition of cut surface | cutting force (N) | depth of corrosion (μm) | workability 700° C. deformability | tensile strength (N/mm$^2$) | elongation (%) | corrosion cracking resistance |
| 5001 | ◎ | ○ | 116 | 70 | ○ | 525 | 34 | ○ |
| 5002 | ◎ | ○ | 120 | 40 | Δ | 501 | 25 | ○ |
| 5003 | ◎ | ○ | 117 | <5 | ○ | 510 | 33 | ○ |
| 5004 | ◎ | ○ | 117 | <5 | Δ | 547 | 42 | ○ |
| 5005 | ◎ | ○ | 115 | <5 | ○ | 533 | 34 | ○ |
| 5006 | ◎ | ○ | 116 | <5 | ○ | 470 | 30 | Δ |
| 5007 | ◎ | ○ | 118 | <5 | ○ | 512 | 28 | ○ |
| 5008 | ◎ | ○ | 119 | <5 | Δ | 558 | 36 | ○ |
| 5009 | ◎ | ○ | 120 | 50 | Δ | 595 | 31 | ○ |
| 5010 | ◎ | ○ | 121 | <5 | ○ | 516 | 27 | ○ |
| 5011 | ◎ | ○ | 118 | <5 | Δ | 569 | 34 | ○ |
| 5012 | ○ | ○ | 117 | <5 | ○ | 523 | 30 | ○ |
| 5013 | ◎ | ○ | 116 | <5 | ○ | 504 | 33 | ○ |
| 5014 | ○ | ○ | 114 | <5 | ○ | 536 | 35 | ○ |
| 5015 | ◎ | ○ | 117 | <5 | ○ | 488 | 31 | ○ |
| 5016 | ◎ | ○ | 116 | <5 | ○ | 510 | 37 | ○ |
| 5017 | ◎ | ○ | 118 | <5 | Δ | 557 | 32 | ○ |
| 5018 | ◎ | ○ | 117 | <5 | ○ | 480 | 30 | ○ |
| 5019 | ◎ | ○ | 117 | <5 | ○ | 511 | 31 | ○ |
| 5020 | ◎ | ○ | 115 | <5 | ○ | 528 | 30 | ○ |

TABLE 23

| | machinability | | | corrosion resistance maximum | hot | mechanical properties | | stress resistance |
|---|---|---|---|---|---|---|---|---|
| No. | form of chippings | condition of cut surface | cutting force (N) | depth of corrosion (μm) | workability 700° C. deformability | tensile strength (N/mm$^2$) | elongation (%) | corrosion cracking resistance |
| 6001 | ◎ | ○ | 119 | 40 | ○ | 515 | 25 | ○ |
| 6002 | ◎ | ○ | 117 | <5 | ○ | 496 | 35 | ○ |
| 6003 | ◎ | ○ | 119 | <5 | Δ | 570 | 34 | ○ |
| 6004 | ◎ | ○ | 118 | <5 | Δ | 503 | 26 | ○ |
| 6005 | ◎ | ○ | 115 | <5 | ○ | 536 | 37 | ○ |
| 6006 | ○ | ○ | 113 | <5 | ○ | 512 | 33 | ○ |
| 6007 | ◎ | ○ | 117 | <5 | Δ | 559 | 29 | ○ |
| 6008 | ○ | ○ | 115 | <5 | Δ | 527 | 31 | ○ |
| 6009 | ◎ | ○ | 115 | <5 | Δ | 546 | 40 | ○ |
| 6010 | ◎ | ○ | 116 | <5 | ○ | 507 | 30 | ○ |
| 6011 | ○ | ○ | 113 | <5 | Δ | 520 | 30 | ○ |
| 6012 | ◎ | ○ | 115 | <5 | Δ | 488 | 29 | Δ |
| 6013 | ○ | ○ | 114 | <5 | ○ | 531 | 32 | ○ |
| 6014 | ◎ | ○ | 114 | <5 | Δ | 564 | 31 | ○ |
| 6015 | ◎ | ○ | 115 | 20 | ○ | 525 | 34 | ○ |
| 6016 | ◎ | ○ | 121 | 30 | ○ | 514 | 25 | ○ |
| 6017 | ◎ | ○ | 119 | <5 | ○ | 510 | 27 | ○ |
| 6018 | ◎ | ○ | 116 | <5 | ○ | 528 | 32 | ○ |
| 6019 | ◎ | ○ | 119 | <5 | ○ | 526 | 28 | ○ |
| 6020 | ◎ | ○ | 116 | <5 | ○ | 509 | 30 | ○ |

TABLE 24

| | machinability | | | corrosion resistance maximum | hot | mechanical properties | | stress resistance |
|---|---|---|---|---|---|---|---|---|
| No. | form of chippings | condition of cut surface | cutting force (N) | depth of corrosion (μm) | workability 700° C. deformability | tensile strength (N/mm$^2$) | elongation (%) | corrosion cracking resistance |
| 6021 | ◎ | ○ | 113 | <5 | ○ | 534 | 30 | ○ |
| 6022 | ◎ | ○ | 117 | <5 | ○ | 562 | 34 | ○ |
| 6023 | ◎ | ○ | 120 | <5 | ○ | 527 | 27 | ○ |
| 6024 | ◎ | ○ | 116 | <5 | ○ | 515 | 33 | ○ |
| 6025 | ◎ | ○ | 117 | <5 | Δ | 575 | 35 | ○ |

TABLE 24-continued

| No. | machinability: form of chippings | machinability: condition of cut surface | machinability: cutting force (N) | corrosion resistance maximum depth of corrosion (μm) | hot workability 700° C. deformability | mechanical properties: tensile strength (N/mm$^2$) | mechanical properties: elongation (%) | stress resistance corrosion cracking resistance |
|---|---|---|---|---|---|---|---|---|
| 6026 | ◎ | ○ | 114 | <5 | ○ | 524 | 32 | ○ |
| 6027 | ◎ | ○ | 119 | <5 | ○ | 503 | 34 | ○ |
| 6028 | ◎ | ○ | 117 | <5 | ○ | 510 | 33 | ○ |
| 6029 | ○ | ○ | 114 | <5 | Δ | 522 | 30 | ○ |
| 6030 | ◎ | ○ | 118 | 40 | ○ | 546 | 37 | ○ |
| 6031 | ◎ | ○ | 119 | <5 | ○ | 529 | 27 | ○ |
| 6032 | ◎ | ○ | 115 | <5 | Δ | 545 | 30 | ○ |
| 6033 | ◎ | ○ | 116 | <5 | ○ | 521 | 34 | ○ |
| 6034 | ◎ | ○ | 116 | <5 | ○ | 513 | 31 | ○ |
| 6035 | ◎ | ○ | 118 | <5 | Δ | 568 | 35 | ○ |
| 6036 | ◎ | ○ | 118 | <5 | ○ | 536 | 26 | ○ |
| 6037 | ○ | ○ | 116 | <5 | ○ | 530 | 29 | ○ |
| 6038 | ◎ | ○ | 117 | <5 | Δ | 555 | 30 | ○ |
| 6039 | ◎ | ○ | 117 | 20 | ○ | 497 | 31 | ○ |
| 6040 | ◎ | ○ | 118 | <5 | Δ | 574 | 35 | ○ |

TABLE 25

| No. | machinability: form of chippings | machinability: condition of cut surface | machinability: cutting force (N) | corrosion resistance maximum depth of corrosion (μm) | hot workability 700° C. deformability | mechanical properties: tensile strength (N/mm$^2$) | mechanical properties: elongation (%) | stress resistance corrosion cracking resistance |
|---|---|---|---|---|---|---|---|---|
| 6041 | ◎ | ○ | 115 | <5 | ○ | 520 | 34 | ○ |
| 6042 | ◎ | ○ | 117 | 20 | Δ | 501 | 31 | ○ |
| 6043 | ◎ | ○ | 118 | <5 | Δ | 585 | 32 | ○ |
| 6044 | ◎ | ○ | 116 | <5 | ○ | 516 | 32 | ○ |
| 6045 | ◎ | ○ | 116 | <5 | ○ | 538 | 35 | ○ |

TABLE 26

| No. | machinability: form of chippings | machinability: condition of cut surface | machinability: cutting force (N) | hot workability 700° C. deformability | mechanical properties: tensile strength (N/mm$^2$) | mechanical properties: elongation (%) |
|---|---|---|---|---|---|---|
| 7001 | ◎ | ○ | 132 | ○ | 755 | 17 |
| 7002 | ◎ | ○ | 127 | ○ | 776 | 19 |
| 7003 | ◎ | Δ | 135 | ○ | 620 | 15 |
| 7004 | ◎ | ○ | 130 | ○ | 714 | 18 |
| 7005 | ◎ | ○ | 128 | ○ | 708 | 19 |
| 7006 | ◎ | ○ | 130 | ○ | 685 | 16 |
| 7007 | ◎ | ○ | 132 | ○ | 717 | 18 |
| 7008 | ◎ | ○ | 130 | ○ | 811 | 18 |
| 7009 | ◎ | ○ | 130 | ○ | 790 | 15 |
| 7010 | ◎ | ○ | 131 | ○ | 708 | 18 |
| 7011 | ◎ | ○ | 128 | ○ | 810 | 17 |
| 7012 | ◎ | ○ | 128 | ○ | 694 | 17 |
| 7013 | ◎ | ○ | 132 | ○ | 742 | 16 |
| 7014 | ◎ | ○ | 128 | ○ | 809 | 17 |
| 7015 | ◎ | ○ | 129 | ○ | 725 | 15 |
| 7016 | ◎ | ○ | 128 | ○ | 765 | 18 |
| 7017 | ◎ | ○ | 130 | ○ | 684 | 16 |

TABLE 26-continued

| No. | machinability: form of chippings | machinability: condition of cut surface | machinability: cutting force (N) | hot workability 700° C. deformability | mechanical properties: tensile strength (N/mm$^2$) | mechanical properties: elongation (%) |
|---|---|---|---|---|---|---|
| 7018 | ◎ | ○ | 128 | ○ | 710 | 21 |
| 7019 | ◎ | ○ | 128 | ○ | 746 | 20 |
| 7020 | ◎ | ○ | 126 | ○ | 802 | 19 |

TABLE 27

| No. | machinability: form of chippings | machinability: condition of cut surface | machinability: cutting force (N) | hot workability 700° C. deformability | mechanical properties: tensile strength (N/mm$^2$) | mechanical properties: elongation (%) |
|---|---|---|---|---|---|---|
| 7021 | ◎ | ○ | 126 | ○ | 792 | 19 |
| 7022 | ◎ | ○ | 128 | ○ | 762 | 20 |
| 7023 | ◎ | ○ | 129 | ○ | 725 | 17 |
| 7024 | ◎ | ○ | 128 | ○ | 744 | 21 |
| 7025 | ◎ | ○ | 130 | ○ | 750 | 20 |
| 7026 | Δ | ○ | 132 | ○ | 671 | 23 |
| 7027 | ◎ | ○ | 128 | ○ | 740 | 23 |
| 7028 | ◎ | ○ | 133 | ○ | 763 | 22 |
| 7029 | Δ | ○ | 129 | ○ | 647 | 24 |

TABLE 28

| No. | machinability: from of chippings | machinability: condition of cut surface | machinability: cutting force (N) | corrosion resistance maximum depth of corrosion (μm) | hot workability 700° C. deformability | mechanical properties: tensile strength (N/mm$^2$) | mechanical properties: elongation (%) | stress resistance corrosion cracking resistance | high-temperature oxidation increase in weight by oxidation (mg/10 cm$^2$) |
|---|---|---|---|---|---|---|---|---|---|
| 8001 | ◎ | ○ | 114 | <5 | ○ | 528 | 35 | ○ | 0.5 |
| 8002 | ◎ | ○ | 116 | <5 | ○ | 545 | 37 | ○ | 0.2 |
| 8003 | ○ | ○ | 113 | <5 | Δ | 547 | 34 | ○ | 0.4 |
| 8004 | ◎ | ○ | 116 | 40 | ○ | 482 | 30 | Δ | 0.5 |
| 8005 | ◎ | ○ | 117 | <5 | ○ | 502 | 32 | ○ | 0.3 |
| 8006 | ◎ | ○ | 117 | <5 | Δ | 570 | 36 | ○ | 0.4 |
| 8007 | ◎ | ○ | 117 | <5 | ○ | 575 | 33 | ○ | 0.2 |
| 8008 | ◎ | ○ | 118 | <5 | ○ | 552 | 36 | ○ | 0.3 |

TABLE 29

| No. | machinability: from of chippings | machinability: condition of cut surface | machinability: cutting force (N) | corrosion resistance maximum depth of corrosion (μm) | hot workability 700° C. deformability | mechanical properties: tensile strength (N/mm$^2$) | mechanical properties: elongation (%) | stress resistance corrosion cracking resistance | high-temperature oxidation increase in weight by oxidation (mg/10 cm$^2$) |
|---|---|---|---|---|---|---|---|---|---|
| 9001 | ◎ | ○ | 115 | <5 | ○ | 526 | 33 | ○ | 0.4 |
| 9002 | ○ | ○ | 113 | 20 | Δ | 543 | 30 | ○ | 0.3 |
| 9003 | ○ | ○ | 115 | <5 | Δ | 508 | 28 | ○ | 0.4 |
| 9004 | ◎ | ○ | 117 | <5 | ○ | 567 | 37 | ○ | 0.2 |
| 9005 | ◎ | ○ | 115 | <5 | Δ | 571 | 33 | ○ | 0.4 |
| 9006 | ◎ | ○ | 116 | <5 | ○ | 513 | 35 | ○ | 0.4 |

TABLE 30

| No. | machinability: from of chipp-ings | machinability: condition of cut surface | machinability: cutting force (N) | corrosion resistance maximum depth of corrosion (μm) | hot workability 700° C. deformability | mechanical properties: tensile strength (N/mm$^2$) | mechanical properties: elongation (%) | stress resistance corrosion cracking resistance | high-temperature oxidation increase in weight by oxidation (mg/10 cm$^2$) |
|---|---|---|---|---|---|---|---|---|---|
| 10001 | ◎ | ○ | 115 | <5 | ○ | 534 | 38 | ○ | 0.1 |
| 10002 | ◎ | ○ | 116 | 10 | ○ | 538 | 36 | ○ | 0.4 |
| 10003 | ◎ | ○ | 117 | <5 | ○ | 563 | 39 | ○ | <0.1 |
| 10004 | ◎ | ○ | 115 | <5 | ○ | 505 | 30 | Δ | 0.2 |
| 10005 | ◎ | ○ | 116 | <5 | Δ | 572 | 38 | ○ | 0.2 |
| 10006 | ◎ | ○ | 115 | <5 | ○ | 514 | 28 | ○ | 0.1 |
| 10007 | ◎ | ○ | 114 | <5 | ○ | 525 | 34 | ○ | 0.2 |
| 10008 | ◎ | ○ | 115 | 20 | ○ | 530 | 36 | ○ | 0.2 |

TABLE 31

| No. | machinability: from of chipp-ings | machinability: condition of cut surface | machinability: cutting force (N) | corrosion resistance maximum depth of corrosion (μm) | hot workability 700° C. deformability | mechanical properties: tensile strength (N/mm$^2$) | mechanical properties: elongation (%) | stress resistance corrosion cracking resistance | high-temperature oxidation increase in weight by oxidation (mg/10 cm$^2$) |
|---|---|---|---|---|---|---|---|---|---|
| 11001 | ◎ | ○ | 115 | <5 | ○ | 552 | 35 | ○ | 0.2 |
| 11002 | ◎ | ○ | 116 | 30 | Δ | 504 | 28 | Δ | 0.2 |
| 11003 | ◎ | ○ | 115 | <5 | Δ | 598 | 34 | ○ | <0.1 |
| 11004 | ◎ | ○ | 116 | <5 | ○ | 515 | 32 | ○ | 0.1 |
| 11005 | ○ | ○ | 113 | <5 | ○ | 540 | 35 | ○ | 0.1 |
| 11006 | ◎ | ○ | 116 | 20 | Δ | 487 | 31 | ○ | 0.1 |
| 11007 | ◎ | ○ | 117 | <5 | ○ | 524 | 32 | ○ | 0.1 |
| 11008 | ○ | ○ | 114 | <5 | ○ | 537 | 30 | ○ | 0.2 |
| 11009 | ◎ | ○ | 115 | <5 | Δ | 569 | 35 | ○ | 0.1 |

TABLE 31-continued

| No. | machinability: from of chipp-ings | machinability: condition of cut surface | machinability: cutting force (N) | corrosion resistance maximum: depth of corrosion (μm) | hot workability 700° C. deformability | mechanical properties: tensile strength (N/mm$^2$) | mechanical properties: elongation (%) | stress resistance: corrosion cracking resistance | high-temperature oxidation: increase in weight by oxidation (mg/10 cm$^2$) |
|---|---|---|---|---|---|---|---|---|---|
| 11010 | ◎ | ○ | 115 | 10 | ○ | 531 | 32 | ○ | 0.1 |
| 11011 | ◎ | ○ | 116 | <5 | ○ | 510 | 29 | ○ | 0.1 |

TABLE 32

| No. | machinability: form of chippings | machinability: condition of cut surface | machinability: cutting force (N) | corrosion resistance maximum: depth of corrosion (μm) | hot workability 700° C. deformability | mechanical properties: tensile strength (N/mm$^2$) | mechanical properties: elongation (%) | stress resistance: corrosion cracking resistance |
|---|---|---|---|---|---|---|---|---|
| 12001 | ◎ | ○ | 122 | 210 | ○ | 486 | 36 | ○ |
| 12002 | ◎ | ○ | 119 | 200 | ○ | 490 | 35 | ○ |
| 12003 | ◎ | ○ | 120 | 160 | Δ | 501 | 40 | ○ |
| 12004 | ◎ | ○ | 119 | 160 | Δ | 505 | 41 | ○ |

TABLE 33

| No. | machinability: form of chippings | machinability: condition of cut surface | machinability: cutting force (N) | corrosion resistance maximum: depth of corrosion (μm) | hot workability 700° C. deformability | mechanical properties: tensile strength (N/mm$^2$) | mechanical properties: elongation (%) | stress resistance: corrosion cracking resistance | high-temperature oxidation: increase in weight by oxidation (mg/10 cm$^2$) |
|---|---|---|---|---|---|---|---|---|---|
| 13001 | ○ | ○ | 103 | 1100 | Δ | 408 | 37 | XX | 1.8 |
| 13002 | ○ | ○ | 101 | 1000 | X | 387 | 39 | XX | 1.7 |
| 13003 | ○ | Δ | 112 | 1050 | ○ | 414 | 38 | XX | 1.7 |
| 13004 | X | ○ | 223 | 900 | ○ | 438 | 38 | X | 1.2 |
| 13005 | X | ○ | 178 | 350 | Δ | 735 | 28 | ○ | 0.2 |
| 13006 | X | ○ | 217 | 600 | ○ | 425 | 39 | X | 1.8 |

TABLE 34

| No. | wear resistance weight loss by wear (mg/100000 rot.) |
|---|---|
| 7001a | 0.7 |
| 7002a | 1.4 |
| 7003a | 2.0 |
| 7004a | 1.4 |
| 7005a | 1.2 |
| 7006a | 1.8 |
| 7007a | 2.3 |
| 7008a | 0.7 |
| 7009a | 0.6 |
| 7010a | 1.3 |
| 7011a | 0.8 |
| 7012a | 1.7 |
| 7013a | 1.1 |
| 7014a | 0.8 |
| 7015a | 1.1 |
| 7016a | 1.0 |
| 7017a | 1.6 |
| 7018a | 1.9 |
| 7019a | 1.1 |
| 7020a | 1.4 |

TABLE 35

| No. | wear resistance weight loss by wear (mg/100000 rot.) |
|---|---|
| 7021a | 1.5 |
| 7022a | 1.4 |
| 7023a | 0.9 |
| 7024a | 2.0 |
| 7025a | 1.2 |
| 7026a | 1.2 |
| 7027a | 1.1 |
| 7028a | 2.1 |
| 7029a | 1.5 |

TABLE 36

| No. | wear resistance weight loss by wear (mg/100000 rot.) |
|---|---|
| 13001a | 500 |
| 13002a | 620 |
| 13003a | 520 |
| 13004a | 450 |

TABLE 36-continued

| No. | wear resistance weight loss by wear (mg/100000 rot.) |
|---|---|
| 13005a | 25 |
| 13006a | 600 |

What is claimed is:

1. A free-cutting copper-silicon-zinc alloy, comprising: 69 to 79 percent, by weight, of copper; 2.0 to 4.0 percent, by weight, of silicon; 0.02 to 0.4 percent, by weight, of lead; and a remaining percentage, by weight, of zinc; wherein an extruded round test piece of the alloy having a circumferential surface, when cut on the circumferential surface by a lathe provided with a point nose straight tool at a rake angle of −8 degrees at a cutting rate of 50 m/min, a cutting depth of 1.5 mm and a feed rate of 0.11 min/rev, yields chips having one or more shapes selected from the group consisting of an arc shape and a needle shape.

2. A free-cutting copper-silicon-zinc alloy as defined in claim 1, made by a process comprising the step of subjecting said alloy to a heat treatment for 30 minutes to 5 hours at 400 to 600° C.

3. A free-cutting copper-silicon-zinc alloy, consisting essentially of: 69 to 79 percent, by weight, of copper; 2.0 to 4.0 percent, by weight, of silicon; 0.02 to 0.4 percent, by weight, of lead; and a remaining percentage, by weight, of zinc;

wherein the copper-silicon-zinc alloy includes (a) a matrix comprising an alpha phase, and (b) a gamma phase formed in the matrix, wherein the gamma phase serves to improve machinability of the alloy.

4. A free-cutting copper-silicon-zinc alloy as recited in claim 3, made by a process comprising the step of subjecting the alloy to a heat treatment for 30 minutes to 5 hours at 400 to 600° C. so the one or more phases are finely dispersed in the matrix.

5. A free-cutting copper-silicon-zinc alloy, consisting essentially of: 69 to 79 percent, by weight, of copper; 2.0 to 4.0 percent, by weight, of silicon; 0.02 to 0.4 percent, by weight, of lead; and a remaining percentage, by weight, of zinc; wherein an extruded round test piece of the alloy having a circumferential surface, when cut on the circumferential surface by a lathe provided with a point nose straight tool at a rake angle of −8 degrees at a cutting rate of 50 m/min, a cutting depth of 1.5 mm and a feed rate of 0.11 mm/rev, yields chips having one or more shapes selected from the group consisting of an arc shape and a needle shape.

6. A free-cutting copper-silicon-zinc alloy as defined in claim 5, made by a process comprising the step of subjecting said alloy to a heat treatment for 30 minutes to 5 hours at 400 to 600° C.

7. A free-cutting copper-silicon-zinc alloy containing no tin, comprising: 69 to 79 percent, by weight, of copper; 2.0 to 4.0 percent, by weight, of silicon; 0.02 to 0.4 percent, by weight, of lead; and a remaining percentage, by weight, of zinc;

wherein the copper-silicon-zinc alloy includes (a) a matrix comprising an alpha phase, and (b) a gamma phase formed in the matrix, wherein the gamma phase serves to improve machinability of the alloy.

8. A free-cutting copper-silicon-zinc alloy containing no tin, comprising: 69 to 79 percent, by weight, of copper; 2.0 to 4.0 percent, by weight, of silicon; 0.02 to 0.4 percent, by weight, of lead; and a remaining percentage, by weight, of zinc; wherein an extruded round test piece of the alloy having a circumferential surface, when cut on the circumferential surface by a lathe provided with a point nose straight tool at a rake angle of −8 degrees at a cutting rate of 50 m/min, a cutting depth of 1.5 mm and a feed rate of 0.11 min/rev, yields chips having one or more shapes selected from the group consisting of an arc shape and a needle shape.

9. A free-cutting copper-silicon-zinc alloy, comprising: 69 to 79 percent, by weight, of copper; 2.0 to 4.0 percent, by weight, of silicon; 0.02 to 0.4 percent, by weight, of lead; and a remaining percentage, by weight, of zinc;

wherein the copper-silicon-zinc alloy includes (a) a matrix comprising an alpha phase, and (b) a kappa phase, or a kappa phase and a gamma phase, formed in the matrix, wherein the gamma phase and the kappa phase serve to improve machinability of the alloy.

10. A free-cutting copper-silicon-zinc alloy, comprising: 69 to 79 percent, by weight, of copper; 2.0 to 4.0 percent, by weight, of silicon; 0.02 to 0.4 percent, by weight, of lead; and a remaining percentage, by weight, of zinc;

wherein the copper-silicon-zinc alloy includes (a) a matrix comprising an alpha phase, and (b) a gamma phase and a kappa phase, wherein the gamma phase and the kappa phase are formed in the matrix.

11. A free-cutting copper-silicon-zinc alloy, comprising: 69 to 79 percent, by weight, of copper; 2.0 to 4.0 percent, by weight, of silicon; 0.02 to 0.4 percent, by weight, of lead; and a remaining percentage, by weight, of zinc;

wherein the copper-silicon-zinc alloy includes (a) a matrix comprising an alpha phase, and (b) a kappa phase, or a kappa phase and a gamma phase, wherein the kappa phase is formed in the matrix, and the gamma phase is formed in the matrix.

12. A free-cutting copper-silicon-zinc alloy as recited in claim 11, wherein the alloy includes a gamma phase.

13. A free-cutting copper-silicon-zinc alloy containing no tin, comprising: 69 to 79 percent, by weight, of copper; 2.0 to 4.0 percent, by weight, of silicon; 0.02 to 0.4 percent, by weight, of lead; and a remaining percentage, by weight, of zinc;

wherein the copper-silicon-zinc alloy includes (a) a matrix comprising an alpha phase, and (b) a kappa phase, or a kappa phase and a gamma phase, wherein the kappa phase is formed in the matrix, and the gamma phase is formed in the matrix.

14. A free-cutting copper-silicon-zinc alloy as recited in claim 13, wherein the alloy includes a gamma phase.

15. A free-cutting copper-silicon-zinc alloy, consisting essentially of: 69 to 79 percent, by weight, of copper; 2.0 to 4.0 percent, by weight, of silicon; 0.02 to 0.4 percent, by weight, of lead; and a remaining percentage, by weight, of zinc;

wherein the copper-silicon-zinc alloy includes (a) a matrix comprising an alpha phase, and (b) a kappa phase, or a kappa phase and a gamma phase, wherein the kappa phase is formed in the matrix and the gamma phase is formed in the matrix.

16. A free-cutting copper-silicon-zinc alloy, consisting of: 69 to 79 percent, by weight, of copper; 2.0 to 4.0 percent, by weight, of silicon; 0.02 to 0.4 percent, by weight, of lead; and a remaining percentage, by weight, of zinc;

wherein the copper-silicon-zinc alloy includes (a) a matrix comprising an alpha phase, and (b) a gamma phase formed in the matrix.

17. A free-cutting copper-silicon-zinc alloy, consisting of: 69 to 79 percent, by weight, of copper; 2.0 to 4.0 percent, by weight, of silicon; 0.02 to 0.4 percent, by weight, of lead; and a remaining percentage, by weight, of zinc;

wherein the copper-silicon-zinc alloy includes (a) a matrix comprising an alpha phase, and (b) a kappa phase, or a kappa phase and a gamma phase, wherein the kappa phase is formed in the matrix and the gamma phase is formed in the matrix.

18. A free-cutting copper-silicon-zinc alloy, comprising: 69 to 79 percent, by weight, of copper; 2.0 to 4.0 percent, by weight, of silicon; 0.02 to 0.4 percent, by weight, of lead; and a remaining percentage, by weight, of zinc;

wherein the copper-silicon-zinc alloy includes (a) a matrix comprising an alpha phase, and (b) a gamma phase formed in the matrix, wherein the gamma phase serves to improve machinability of the alloy, and wherein an extruded round test piece of the alloy having a circumferential surface, when cut on the circumferential surface by a lathe provided with a point nose straight tool at a rake angle of −8 degrees at a cutting rate of 50 m/min, a cutting depth of 1.5 mm and a feed rate of 0.11 mm/rev, yields chips having one or more shapes selected from the group consisting of an arc shape and a needle shape.

19. A free-cutting copper-silicon-zinc alloy as recited in claim 18, made by a process comprising the step of subjecting the alloy to a heat treatment for 30 minutes to 5 hours at 400 to 600° C. so the one or more phases are finely dispersed in the matrix.

* * * * *